US007782269B2

(12) United States Patent
Soler Castany et al.

(10) Patent No.: US 7,782,269 B2
(45) Date of Patent: Aug. 24, 2010

(54) ANTENNA STRUCTURE FOR A WIRELESS DEVICE WITH A GROUND PLANE SHAPED AS A LOOP

(75) Inventors: Jordi Soler Castany, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 580 days.

(21) Appl. No.: 11/719,151

(22) PCT Filed: Nov. 14, 2005

(86) PCT No.: PCT/EP2005/055959

§ 371 (c)(1),
(2), (4) Date: Jun. 13, 2007

(87) PCT Pub. No.: WO2006/051113

PCT Pub. Date: May 18, 2006

(65) Prior Publication Data

US 2007/0252773 A1 Nov. 1, 2007

Related U.S. Application Data

(60) Provisional application No. 60/627,653, filed on Nov. 12, 2004.

(51) Int. Cl.
*H01Q 1/48* (2006.01)

(52) U.S. Cl. ..... 343/846; 343/700 MS

(58) Field of Classification Search ..... 343/700 MS, 343/702, 846, 848
See application file for complete search history.

(56) References Cited

U.S. PATENT DOCUMENTS 4,843,468 A 6/1989 Drewery 5,363,114 A 11/1994 Shoemaker (Continued)

FOREIGN PATENT DOCUMENTS

DE 10345230 A1 4/2005

(Continued)

OTHER PUBLICATIONS

Chiou, Designs of compact microstrip antennas with a slotted ground plane, Antennas and propagation society international symposium, Jul. 2001.

Huang, Dielectric resonator antenna on a slotted ground plane, IEEE Antennas and Propagation Society International Symposium and USCN/URSI National Radio Science Meeting, Jul. 2001.

Hossa, Improvement of compact terminal antenna performance by incorporating open-end slots in ground plane, Microwave and Wireless Components Letters, Jun. 2004, vol. 14, No. 6.

(Continued)

*Primary Examiner*—Tan Ho
(74) *Attorney, Agent, or Firm*—Kenyon & Kenyon LLP

(57) ABSTRACT

This invention refers to an antenna structure for a wireless device comprising a ground plane and an antenna element, wherein the ground plane has the shape of an open loop. The invention further refers to an antenna structure for a wireless device, such as a light switch or a wristsensor or wristwatch, comprising an open loop ground plane having a first end portion and a second end portion, the open loop ground plane defining an opening between the first end portion and the second end portion; and an antenna component positioned within the opening defined between the first end portion and the second end portion and overlapping at least one of the first end portion or the second end portion. Further the invention refers to a corresponding wireless device and to a method for integrating such an antenna structure in a wireless device.

40 Claims, 21 Drawing Sheets

U.S. PATENT DOCUMENTS

| | | | | |
|---|---|---|---|---|
| 5,666,125 | A | 9/1997 | Luxon et al. | |
| 5,784,032 | A | 7/1998 | Johnston et al. | |
| 5,886,669 | A | 3/1999 | Kita | |
| 6,011,518 | A | 1/2000 | Yamagishi et al. | |
| 6,011,519 | A | 1/2000 | Sadler et al. | |
| 6,087,990 | A | 7/2000 | Thill et al. | |
| 6,140,975 | A | 10/2000 | Cohen | |
| 6,300,908 | B1 | 10/2001 | Jecko et al. | |
| 6,489,925 | B2 | 12/2002 | Thursby et al. | |
| 7,196,674 | B2 | 3/2007 | Timofeev et al. | |
| 7,511,675 | B2 | 3/2009 | Puente-Baliarda et al. | |
| 2001/0006490 | A1 | 7/2001 | Dinger | |
| 2003/0169207 | A1 | 9/2003 | Beigel | |
| 2003/0193437 | A1* | 10/2003 | Kangasvieri et al. | 343/702 |
| 2004/0058723 | A1 | 3/2004 | Mikkola et al. | |
| 2004/0104851 | A1 | 6/2004 | Kadambi et al. | |
| 2004/0217916 | A1 | 11/2004 | Quintero Illera et al. | |
| 2004/0222930 | A1 | 11/2004 | Sun | |
| 2005/0253758 | A1* | 11/2005 | Il et al. | 343/702 |

FOREIGN PATENT DOCUMENTS

| | | | |
|---|---|---|---|
| EP | 0323664 | A2 | 7/1989 |
| EP | 1223637 | B1 | 9/1999 |
| EP | 0969375 | | 1/2000 |
| EP | 1280224 | A1 | 1/2003 |
| EP | 1441412 | A1 | 1/2003 |
| EP | 1447879 | A1 | 8/2004 |
| EP | 00909089.5 | B1 | 8/2005 |
| ES | 2112163 | | 3/1998 |
| WO | 9706578 | | 2/1997 |
| WO | 9706578 | A1 | 2/1997 |
| WO | 9927608 | | 6/1999 |
| WO | 0154225 | A1 | 7/2000 |
| WO | 0117063 | A1 | 3/2001 |
| WO | 0154225 | A1 | 7/2001 |
| WO | 0229929 | A2 | 4/2002 |
| WO | 03023900 | A1 | 3/2003 |
| WO | 03034538 | A1 | 4/2003 |
| WO | 2004001894 | A1 | 12/2003 |
| WO | 2006032455 | A1 | 3/2006 |
| WO | 2006070017 | A1 | 7/2006 |

OTHER PUBLICATIONS

Collins, Antenna with a reduced ground plane size, IEEE Antennas and Propagation Society International Symposium, 2002.

Ke, Broadband proximity-coupled microstrip antennas with an H-shaped slot in the ground plane, IEEE Antennas and Propagation Society International Symposium, 2002.

Hsu, et al, "Broad-band probe-fed patch antenna with a U-shaped ground plane for cross-polarization reduction," IEEE Transactions on Antennas and Propagation 50(3): 352-355, Mar. 2002.

Chang, et al, "Broadband patch antenna edge-fed by a coplanar probe feed," Microwave and Optical Technology Letters: 31(4): 287-289, Nov. 20, 2001.

Bhavsar, Samir A.: Letter: Fractus v. Samsung et al., Case No. 6:09-cv-00203-Led: Disclosure of Material Information to the USPTO; Oct. 28, 2009.

Wille, David G.: HTC's First Amended Answer and Counterclaim; Oct. 2, 2009.

Wimer, Michael C.; USPTO Office Actions for U.S. Appl. No. 10/422,578; Oct. 4, 2004, Apr. 7, 2005, Aug. 24, 2005, Jan. 26, 2006, Mar. 12, 2007, Aug. 23, 2007 and Mar. 26, 2008.

D.A. Russell, J.D. Hanson, E. Ott, "Dimension and Strange Attractors", Phys. Rev. Lett. 45 (1980) 1175-1178.

Paul So., Ernest Barreto, and Brian R. Hunt, "Box-counting dimension without boxes: Computing D0 from average expansion rates", Physical Review E (Statistical Physics, Plasmas, Fluids, and Related Interdisciplinary Topics)—Jul. 1999—vol. 60, Issue 1, pp. 378-385.

Heinz-Otto Peitgen, et al, "Chaos and Fractals—New Frontiers of Science" (1992), pp. 212-216, 387-388.

Paul S. Addison, "Fractals and Chaos—An illustrated Course"(Institute of Physics Publishing, Bristol and Philadelphia; IOP Publishing 1997), pp. 30, 31 &33.

Kenneth Falconer, "Fractal Geometry—Mathematical Foundations and Applications"(2nd edition) (John Wiley & Sons. Ltd., 2003) (the first edition is from 1990).

Yuan Y. Tang. et al., "The application of Fractal Analysis to Feature Extraction"(1999 IEEE). pp. 875-879.

Vincent Ng. et al., "Diagnosis of Melanoma with Fractal Dimensions" (IEEE TENCON'93 / Beijing), pp. 514-517.

S. Kobayashi et al., "Estimation of 3d Fractal Dimension of Real Electrical Tree Patterns" (IEEE 1994; Proceedings of the 4th International Conference on Properties and Applications of Dielectric Materials, Jul. 3-8, 1994 Brisbane, Australia), pp. 359-362.

Jie Feng et al., "Fractional Box-Counting Approach to Fractal Dimension Estimation", (IEEE 1996; Proceedings of ICPR'96), pp. 854-858.

S. Rouvier, et al., "Fractal Analysis of Bidimensional Profiles and Application to Electromagnetic Scattering from Soils"(1996 IEEE), pp. 2167-2169.

Nirupam Sarkar, et al., "An Efficient Differential Box-Counting Approach to Compute Fractal Dimension of Image"(IEEE Transactions on Systems, Man, and Cybernetics, vol. 24, No. 1, Jan. 1994), pp. 115-120.

Susan S. Chen, et al., "On the Calculation of Fractal Features from Images"(IEEE Transactions on Pattern Analysis and Machine Intelligence, vol. 15, No. 10, Oct. 1993), pp. 1087-1090.

Alan I. Penn, et al., "Fractal Dimension of Low-Resolution Medical Images"(18th Annual International Conference of the IEEE Engineering in Medicine and Biology Society, Amsterdam 1996; 4.5.3: Image Pattern Analysis I), pp. 1163-1165.

Fabrizio Berizzi, et al., "Fractal Analysis of the Signal Scattered from the Sea Surface"(IEEE Transactions on Antennas and Propagation, vol. 47, No. 2, Feb. 1999), pp. 324-338.

Hendrik F. V Boshoff, "A Fast Box Counting Algorithm for Determining the Fractal Dimension of Sampled Continuous Functions"(1992 IEEE), pp. 43-48.

Aug. 14, 2003 Reply to Examination Report for EP1258054 (00909089.5).

Oct. 28, 2004 Summons for EP1258054 (00909089.5).

Dec. 15, 2004 Letter Dealing with Oral Proceedings for EP1258054 (00909089.5).

Jan. 2005 Minutes from Oral Proceedings for EP1258054 (00909089.5).

International Preliminary Examination Report and International Search Report of Aug. 29, 2002 for PCT/EP00/00411 published as WO 01/54225 A1.

EPO Office Action for EP1258054 (00909089.5) dated Feb 7, 2003.

Hansen, R. C.: "Fundamental Limitations in Antennas"; Proceedings of the IEEE, IEEE. New York, US; Feb. 1981; ISSN 0018-9219, vol. 2, NR. 69, pp. 170-182.

Ramesh Garg et al., "Microstrip Antenna Design Handbook" (2001, Artech House, Inc.), selected pages.

Richard C. Johnson (Editor), "Antenna Engineering Handbook"(1992, McGraw Hill Inc.), Chapter "Microstrip Antennas" by Robert E. Munson, selected pages.

Constantine A. Balanis, "Antenna Theory"(1982, John Wiley & Sons, Inc.),selected pages.

Keith R. Carver et al., "Microstrip Antenna Technology" (IEEE Transactions on Antennas and Propagation, vol. AP-29, No. 1, Jan. 1981), pp. 2-23.

David M. Pozar et al., "Microstrip Antennas—The Analysis and Design of Microstrip Antennas and Arrays"(1995, Institute of Electrical and Electronic Engineers, Inc.), p. ix and 3.

John D. Kraus, "Antennas"(1988, McGraw-Hill, Inc.), preface and list of contents.

* cited by examiner

ANTENNA STRUCTURE FOR A WIRELESS DEVICE WITH A GROUND PLANE SHAPED AS A LOOP

CROSS REFERENCE TO RELATED APPLICATIONS

This is a 371 national phase application of PCT/EP2005/055959, filed Nov. 14, 2005. This application also claims priority to U.S. Provisional Application Ser. No. 60/627,653, filed Nov. 12, 2004 and is incorporated by reference.

This application is related to application No. 60/627,653 filed on Nov. 12, 2004, in the U.S. and claims priority to that application, which is incorporated herein by reference.

BACKGROUND OF THE INVENTION

1. Field of the Invention

The present invention refers to an antenna structure for a wireless device which comprises a ground plane and an antenna element. Further the invention refers to a wireless device with such an antenna structure and to a method for integrating such an antenna structure within a wireless device.

2. Description of Related Art

For wireless devices it is known to have an antenna element with an associated ground plane. By feeding electric signals to the antenna element, electric fields extend between portions of the antenna element and of the ground plane which leads to radiation of the antenna element. With this radiation, wireless data transfer is possible.

Some times the term ground counterpoise is used instead of ground plane.

The combinations of an antenna element and a ground plane are known as much as for a transmitter as for a receiver.

For wireless devices it is desirable to miniaturize the antenna structures in order to allow for smaller wireless devices or for more room in the wireless devices for other components.

SUMMARY OF THE INVENTION

The object of the present invention is, therefore, to provide an antenna structure, a wireless device and a method to integrate an antenna structure which allows for a reduced size of the wireless devices with respect to known wireless devices.

This object is achieved for example by an antenna structure as of claim 1 and/or as of claim 25, a wireless device as of claim 26 and a method as of claim 28. Preferred embodiments are disclosed in the dependent claims.

The ground plane here is shaped as an open loop. Instead of the term open loop also a term semi loop could be used for the same.

The term "ground plane" does not mean that this item is plane. It may have any shape. The term ground plane, however, is (commonly) used in order to describe a conductor that is associated with the antenna element. As mentioned above the term ground counterpoise may be used instead.

For antenna performances, it is usually desirable to have a ground plane which has an extension of approximately $\lambda/4$ or (odd) multiples thereof. For the miniaturization of such devices, extended ground planes, however, do not fit with such a requirement into the small devices. By forming the ground plane as an open loop, the ground plane can be essentially folded together such that it fits within a smaller area.

Further, the electrical relevant length, however, may be larger than the extension of the ground plane since the loop is not closed but open.

The semi-loop or open loop antenna ground plane described herein may have particular utility in compact and small devices in which the size of the ground plane is an important design parameter. For example, the open-loop ground plane may be particularly useful in wireless devices. The open-loop antenna ground plane may, for example, be used in networking, home control, building and industrial automation, medical and biological sensors and monitoring devices, and/or other applications. The open-loop ground plane may, for example, have utility in various wireless devices, including without limitation, the following types of devices:

mini-PCI (e.g., notebook PC with integrated Wi-Fi module);

compact flash wireless cards;

wireless USB/UART dongles;

PCMCIA wireless cards;

headsets;

pocket PC with integrated Wi-Fi;

access points for hot-spots;

wireless light switches;

wireless wrist watches; and wireless wrist sensors or communication devices.

Preferably, the ground plane has at least one end portion where the antenna element is located in the proximity of the end portion. This allows for a proper electromagnetic coupling between the antenna element and the ground plane which leads to good radiation performance. It may, however, also be possible to place the antenna element at any other part of the ground plane away from the end portions thereof.

The ground plane preferably has a second end portion which is also located in the proximity of the antenna element. It is thereby possible to use the antenna as a loop antenna. Apart from that, this design allows for a very compact shaped ground plane.

Even more compact ground planes are achieved by ground planes which have at least two overlapping portions. The overlapping portions which are in a close relationship, however, do not have a direct electrically conducting connection. This allows for a lengthy electrically relevant length without, however, increasing the physical space requirement for the ground plane. The overlapping portions provide for a certain capacitance. In another preferred embodiment a distinct capacitor may be connected to the ground plane additionally or instead of providing the overlapping portions.

In order to achieve a good antenna efficiency, it is advantageous to provide the antenna element in the proximity of the overlapping portion. This also allows for certain connection modes where the antenna is used e.g. as a loop antenna or an inverted F-antenna (IFA) or a planar inverted-F antenna (PIFA).

In order to achieve a reasonably good electromagnetic coupling between the antenna element with the ground plane, the antenna element is preferably provided in a distance and/or separation from the ground plane and/or the end portions thereof not further than 2.0, 1.75, 1.5, 1.25, 1.0, 0.75, 0.5, 0.25, 0.1, or 0.05 times the largest extension of the antenna element or of the ground plane. In this case the antenna element may be said to be in proximity to the ground plane and/or the end portions thereof.

For flat antenna structure designs it is desirable to have the antenna element as close as possible to the ground plane including with no separation at all. There may be some insulator within the antenna element or the ground plane to avoid an electrical direct contact when the antenna element and the ground plane are in direct mechanical or physical contact.

In a preferred embodiment, the antenna element is essentially flat and arranged essentially parallel to a portion of the ground plane which is in close proximity to the antenna element, typically the portion of the ground plane which is closest to the antenna element. This allows for very flat antenna structure designs which are usually desirable for wireless devices.

For monopole antennas mounted substantially parallel to the ground plane, it is usually not desirable to have the antenna element in complete overlap with the ground plane since then the radiation can not be emitted very efficiently since the currents on the antenna element are essentially canceled by the currents on the ground plane. Therefore, it is usually desirable to have only a certain percentage of the antenna element being overlapped with the ground plane. On the other hand, for patch antennas or micro-strip antennas, it may be desirable to have the antenna element in good overlap with the ground plane. It is also possible to arrange the antenna perpendicular or tilted to the ground plane. Then a good overlap is preferred.

Preferably the ground plane has an opening wherein the antenna element is provided such that it overlaps with an end portion of the ground plane and the opening.

In a preferred embodiment, the ground plane is provided on a circuit board. This allows for low production costs since wireless devices usually already have circuit boards on which ground planes can be provided.

In a further preferred embodiment, the circuit board has one, two, three, four or more openings. This allows for a flexible circuit board design and hence for a flexible design of the ground plane, since mechanical components or electrical components of the wireless device may be located within those openings or be fed through such openings. For example a light switch component that is actuated by a user may be mechanically connected through such openings with a wall part of such a switch, namely the part which is affixed to the wall.

In case of such openings, it is preferable that the ground plane surrounds such openings since thereby the space which is provided on the circuit board in order to define the openings, can be used efficiently.

The ground plane and the antenna element may be provided on the same and/or on opposite sides of the circuit board. If they are provided on opposite sides, then the circuit board allows for a defined separation between the ground plane and the antenna element. If the ground plane is provided on both sides of the circuit board crossings between different portions of the ground plane may be provided where the circuit board acts as an insulator which isolates the two crossing portions against each other.

The antenna element, however, may also be provided on the same side as the ground plane. In this case, however, some insulation between the conductive part of the antenna element and the ground plane has to be achieved, at least partially, where there should be no contact between those two conductive elements.

The ground plane may also be provided as a rigid or at least partially rigid conductor. It may be a stamped metal piece, a bent metal material like a metal ring or the like.

It is also possible that the ground plane is provided as a flexible, or at least partially flexible conducting material, such as a web material, a wire which is preferably flat, a court, a fold, a lace, a string, or the like. This allows for the integration of the ground plane e.g. into textile materials. This is in particular useful for bands for wristwatches, wristbands, watch straps, bracelets or the like.

In a preferred embodiment, the antenna element is an antenna component. This means that it may be e.g. a surface mount component which can be easily contacted by its contact points by standard surface mount technologies such as soldering.

Further, in a preferred embodiment, the ground plane has the shape of a multi-level structure, is a space filling curve, a grid dimension curve, or a contour curve. This allows for strongly reduced physical size of the ground plane.

The antenna itself may also be provided in the shape of a multi-level structure, a space filling curve, a grid dimension curve, or a contour curve.

The antenna structure may be configured such that it operates in one, two, three or more cellular communication standards and/or communications systems.

Preferred antenna elements are those of a monopole, an IFA, a patch, a microstrip antenna or a PIFA.

In a preferred embodiment there is provided at least one contact point which connects the antenna element and the ground plane by direct electrical contact. This ensures a proper electrical configuration which may be stable over a long time.

Further the antenna element may have a feed point, which allows for feeding the antenna.

The wireless device comprises an antenna structure with a ground plane with an open loop. This wireless device may be made smaller than comparable wireless devices. Apart from that for such wireless devices it is possible to fit the ground plane into the wireless device in case that certain shape restrictions are given in the design of the wireless device. E.g. a wall mounted switch may usually be given with a square, rectangular or circular shape for esthetic reasons.

In the method the wireless device is provided with an open loop ground plane. The antenna element is positioned in a certain relation to said ground plane. Thereby small wireless devices become available.

The antenna element may be said to be within the opening of the ground plane if there exists a view onto the antenna structure such that the opening and the antenna element overlap in that view.

In the following some terms used throughout the description and the claims shall be explained in more detail.

Open Loop

The term "loop", in general, refers to a shape which closes back on itself such as a circle, a square, a rectangle or a ring. If, in such a loop, a portion is taken out, then an open loop is obtained.

Therefore, an open loop may be defined as a loop that is broken, forming an opening between two end portions.

Preferably there is no other portion of the ground plane in the opening. This may be expressed by the fact that no straight line drawn from one end portion to the other end portion crosses any portion of the ground plane.

Other possible definitions as provided in the following may alternatively be used to define the term "open loop".

The open loop may be e.g. given by an area which encloses a certain enclosed area and which area has at least two end portions. The largest diameter of this enclosed area is then larger than the smallest possible closing line between the two end portions.

Another possible definition of an open loop is given by a shape which at a first end portion extends in one direction, and at least one other portion, extends into the anti-parallel direction along the shape starting from the first end portion.

Furthermore, an open loop may be defined by a shape for which there exists a point which is surrounded by a portion or a part of the shape in an angle of at least 180°, 200°, 235°, 270° or 300° or more. The point has to be outside of the shape.

Further, it may be defined by the possibility to locate a circle or an ellipse in contact with at least three, or preferably four or more, distinct points. The circle or ellipse are touched on their outside at these points.

Another possible definition of an open loop is a shape where there exists a surface portion or surface point where in a direction perpendicular away from the shape there is another part of the shape.

Further an open loop may be defined by a shape with an opening between two end portions, wherein the length of a straight line closing the opening has a size of not more than 80%, 70%, 60%, 50%, 40%, 30%, 20% or 10% of the largest extension of the shape.

These different possible definitions of an open loop do not exclude each other but may apply at the same time.

For three-dimensional ground planes it may be defined that if there exists a cross-section or a projection onto a plane that is an open loop the three-dimensional ground plane is said to be an open loop ground plane. In some cases there exists a projection which shows a closed loop, while the open loop ground plane is open in three dimensions.

Space Filling Curves

In one example, the ground plane or one or more of the ground plane elements or ground plane parts may be miniaturized by shaping at least a portion of the conductor as a space-filling curve (SFC). Examples of space filling curves are shown in FIG. 11*b* (see curves 1501 to 1514). A SFC is a curve that is large in terms of physical length but small in terms of the area in which the curve can be included. Space filling curves fill the surface or volume where they are located in an efficient way while keeping the linear properties of being curves. In general space filling curves may be composed of straight, essentially straight and/or curved segments. More precisely, for the purposes of this patent document, a SFC may be defined as follows: a curve having at least five segments that are connected in such a way that each segment forms an angle with any adjacent segments, such that no pair of adjacent segments define a larger straight segment. In addition, a SFC does not intersect with itself at any point except possibly the initial and final point (that is, the whole curve can be arranged as a closed curve or loop, but none of the lesser parts of the curve form a closed curve or loop). A closed loop may form a sub-portion of the open loop ground plane.

A space-filling curve can be fitted over a flat or curved or folded or bent or twisted surface, and due to the angles between segments, the physical length of the curve is larger than that of any straight line that can be fitted in the same area (surface) as the space-filling curve. Additionally, to shape the structure of a miniature ground plane, the segments of the SFCs should be shorter than at least one fifth of the free-space operating wavelength, and possibly shorter than one tenth of the free-space operating wavelength. The space-filling curve should include at least five segments in order to provide some ground plane size reduction, however a larger number of segments may be used. In general, the larger the number of segments and the narrower the angles between them, the smaller the size of the final ground plane.

A SFC may also be defined as a non-periodic curve including a number of connected straight or essentially straight segments smaller than a fraction of the operating free-space wave length, where the segments are arranged in such a way that no adjacent and connected segments form another longer straight segment and wherein none of said segments intersect each other.

In one example, a ground plane geometry forming a space-filling curve may include at least five segments, each of the at least five segments forming an angle with each adjacent segment in the curve, at least three of the segments being shorter than one-tenth of the longest free-space operating wavelength of the ground plane. Preferably each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the ground plane. Some space-filling curves might approach a self-similar or self-affine curve, while some others would rather become dissimilar, that is, not displaying self-similarity or self-affinity at all (see for instance 1510, 1511, 1512).

Box-Counting Curves

In another example, the ground plane or one or more of the ground plane elements or ground plane parts may be miniaturized by shaping at least a portion of the conductor to have a selected box-counting dimension. For a given geometry lying on a surface, the box-counting dimension is computed as follows. First, a grid with rectangular or substantially squared identical boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of this document, the box-counting dimension may be computed by placing the first and second grids inside a minimum rectangular area enclosing the conductor of the ground plane and applying the above algorithm. The first grid in general has n×n boxes and the second grid has 2n×2n boxes matching the first grid. The first grid should be chosen such that the rectangular area is meshed in an array of at least 5×5 boxes or cells, and the second grid should be chosen such that L2=½L1 and such that the second grid includes at least 10×10 boxes. The minimum rectangular area is an area in which there is not an entire row or column on the perimeter of the grid that does not contain any piece of the curve. Further the minimum rectangular area preferably refers to the smallest possible rectangle that completely encloses the curve or the relevant portion thereof.

An example of how the relevant grid can be determined is shown in FIG. 11 *c* to 11 *e*. In FIG. 11 *c* a box-counting curve is shown in it smallest possible rectangle that encloses that curve. The rectangle is divided in a n×n (here as an example 5×5) grid of identical rectangular cells, where each side of the cells corresponds to 1/n of the length of the parallel side of the enclosing rectangle. However, the length of any side of the rectangle (e.g. Lx or Ly in FIG. 11 *d*) may be taken for the calculation of D since the boxes of the second grid (see FIG. 11 *e*) have the same reduction factor with respect to the first grid along the sides of the rectangle in both directions (x and y direction) and hence the value of D will be the same no matter whether the shorter (Lx) or the longer (Ly) side of the rectangle is taken into account for the calculation of D. In some rare cases there may be more than one smallest possible rectangle. In this case the smallest possible rectangle giving the smaller value of D is chosen.

Alternatively the grid may be constructed such that the longer side (see left edge of rectangle in FIG. 11 *c*) of the smallest possible rectangle is divided into n equal parts (see L1 on left edge of grid in FIG. 11 *f*) and the n×n grid of squared boxes has this side in common with the smallest possible rectangle such that it covers the curve or the relevant part of the curve. In FIG. 11 *f* the grid therefore extends to the right of the common side. Here there may be some rows or columns which do not have any part of the curve inside (See the ten boxes on the right hand edge of the grid in FIG. 11 *f*). In FIG. 11 *g* the right edge of the smallest rectangle (See FIG. 11 *c*) is taken to construct the n×n grid of identical square boxes. Hence, there are two longer sides of the rectangular based on which the n×n grid of identical square boxes may be constructed and therefore preferably the grid of the two first grids giving the smaller value of D has to be taken into account.

If the value of D calculated by a first n×n grid of identical rectangular boxes (FIG. 11 *d*) inside of the smallest possible rectangle enclosing the curve and a second 2n×2n grid of identical rectangular boxes (FIG. 11 *e*) inside of the smallest possible rectangle enclosing the curve and the value of D calculated from a first n×n grid of squared identical boxes (see FIG. 11 *f* or FIG. 11 *g*) and a second 2n×2n grid of squared identical boxes where the grid has one side in common with the smallest possible rectangle, differ, then preferably the first and second grid giving the smaller value of D have to be taken into account.

Alternatively a curve may be considered as a box counting curve if there exists no first n×n grid of identical square or identical rectangular boxes and a second 2n×2n grid of identical square or identical rectangular boxes where the value of D is smaller than 1.1, 1.2, 1.25, 1.3, 1.4, 1.5, 1.6, 1.7, 1.8, 1.9, 2.0, 2.1, 2.2, 2.3, 2.4, 2.5, 2.6, 2.7, 2.8, or 2.9.

In any case, the value of n for the first grid should not be more than 5, 7, 10, 15, 20, 25, 30, 40 or 50.

The desired box-counting dimension for the curve may be selected to achieve a desired amount of miniaturization. The box-counting dimension should be larger than 1.1 in order to achieve some ground plane size reduction. If a larger degree of miniaturization is desired, then a larger box-counting dimension may be selected, such as a box-counting dimension ranging from 1.5 to 2 for surface structures, while ranging up to 3 for volumetric geometries. For the purposes of this patent document, curves in which at least a portion of the geometry of the curve or the entire curve has a box-counting dimension larger than 1.1 may be referred to as box-counting curves.

For very small ground planes, for example ground planes that fit within a rectangle having a maximum size equal to one-twentieth the longest free-space operating wavelength of the antenna structure, the box-counting dimension may be computed using a finer grid. In such a case, the first grid may include a mesh of 10×10 equal cells, and the second grid may include a mesh of 20×20 equal cells. The grid-dimension (D) may then be calculated using the above equation.

In general, for a given resonant frequency of the antenna structure, the larger the box-counting dimension, the higher the degree of miniaturization that will be achieved by the ground plane.

One way to enhance the miniaturization capabilities of the ground plane (that is, reducing size while maximizing bandwidth, efficiency and gain of the antenna structure) is to arrange the several segments of the curve of the ground plane pattern in such a way that the curve intersects at least one point of at least 14 boxes of the first grid with 5×5 boxes or cells enclosing the curve (This provides for an alternative definition of a box counting curve). If a higher degree of miniaturization is desired, then the curve may be arranged to cross at least one of the boxes twice within the 5×5 grid, that is, the curve may include two non-adjacent portions inside at least one of the cells or boxes of the grid (Another alternative for defining a box counting curve). The relevant grid here may be any of the above mentioned constructed grids or may be any grid. That means if any 5×5 grid exists with the curve crossing at least 14 boxes or crossing one or more boxes twice the curve may be said to be a box counting curve.

FIG. 11*a* illustrates an example of how the box-counting dimension of a curve 31 is calculated. The example curve 31 is placed under a 5×5 grid 2 (FIG. 11 *a* upper part) and under a 10×10 grid 33 (FIG. 11 *a* lower part). As illustrated, the curve 31 touches N1=25 boxes in the 5×5 grid 32 and touches N2=78 boxes in the 10×10 grid 33. In this case, the size of the boxes in the 5×5 grid 32 is twice the size of the boxes in the 10×10 grid 33. By applying the above equation, the box-counting dimension of the example curve 31 may be calculated as D=1.6415. In addition, further miniaturization is achieved in this example because the curve 31 crosses more than 14 of the 25 boxes in grid 32, and also crosses at least one box twice, that is, at least one box contains two non-adjacent segments of the curve. More specifically, the curve 31 in the illustrated example crosses twice in 13 boxes out of the 25 boxes.

The terms explained above can be also applied to curves that extend in three dimensions. If the extension in the third dimension is rather small the curve will fit into a n×n×1 arrangement of 3D-boxes (cubes of size L1×L1×L1) in a plane. Then the calculations can be performed as described above. Here the second grid will be a 2n×2n×1 grid of cuboids of size L2×L2×L1.

If the extension in the third dimension is larger a n×n×n first grid and an 2n×2n×2n second grid will be taken into account. The construction principles for the relevant grids as explained above for two dimensions apply equally in three dimensions.

The box counting curve preferably is non-periodic. This applies at least to a portion of the box counting curve which is located in an area of more than 30%, 50%, 70%, or 90% of the area which is enclosed by the envelope (see explanation of FIGS. 4*e* and 4*f*) of the box counting curve.

Grid Dimension Curves

In another example, the ground plane or one or more ground plane elements or ground plane parts may be miniaturized by shaping at least a portion of the conductor to include a grid dimension curve. For a given geometry lying on a planar or curved surface, the grid dimension of the curve may be calculated as follows. First, a grid with substantially square identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of this document, the grid dimension may be calculated by placing the first and second grids inside the minimum rectangular area enclosing the curve of the ground plane and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal preferably square cells. The second grid may, for example, be chosen such that each cell of the first grid is divided in 4 equal cells, such that the size of the new cells is L2=½L1, and the second grid includes at least 100 cells.

Depending on the size and position of the squares of the grid the number of squares of the smallest rectangular may vary. A preferred value of the number of squares is the lowest number above or equal to the lower limit of 25 identical squares that arranged in a rectangular or square grid cover the curve or the relevant portion of the curve. This defines the size of the squares. Other preferred lower limits here are 50, 100, 200, 250, 300, 400 or 500. The grid corresponding to that number in general will be positioned such that the curve touches the minimum rectangular at two opposite sides. The grid may generally still be shifted with respect to the curve in a direction parallel to the two sides that touch the curve. Of such different grids the one with the lowest value of D is preferred. Also the grid whose minimum rectangular is touched by the curve at three sides (see as an example FIG. 11 *f* and FIG. 11 *g*) is preferred. The one that gives the lower value of D is preferred here.

The desired grid dimension for the curve may be selected to achieve a desired amount of miniaturization. The grid dimension should be larger than 1 in order to achieve some ground plane size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve or a curve where at least a portion of that curve is having a grid dimension larger than 1 may be referred to as a grid dimension curve.

In general, for a given resonant frequency of the antenna structure, the larger the grid dimension the higher the degree of miniaturization that will be achieved by the ground plane.

One example way of enhancing the miniaturization capabilities of the ground plane (which provides for an alternative way for defining a grid dimension curve) is to arrange the several segments of the curve of the ground plane pattern in such a way that the curve intersects at least one point of at least 50% of the cells of the first grid with at least 25 cells (preferably squares) enclosing the curve. In another example, a high degree of miniaturization may be achieved (giving another alternative definition for grid dimension curves) by arranging the ground plane such that the curve crosses at least one of the cells twice within the 25 cell grid (of preferably squares), that is, the curve includes two non-adjacent portions inside at least one of the cells or cells of the grid. In general the grid may have only a line of cells but may also have at least 2 or 3 or 4 columns or rows of cells.

FIG. 12 shows an example two-dimensional ground plane forming a grid dimension curve with a grid dimension of approximately two. FIG. 13 shows the ground plane of FIG. 12 enclosed in a first grid having thirty-two (32) square cells, each with a length L1. FIG. 14 shows the same ground plane enclosed in a second grid having one hundred twenty-eight (128) square cells, each with a length L2. The length (L1) of each square cell in the first grid is twice the length (L2) of each square cell in the second grid (L1=2×L2). An examination of FIG. 13 and FIG. 14 reveal that at least a portion of the ground plane is enclosed within every square cell in both the first and second grids. Therefore, the value of N1 in the above grid dimension (Dg) equation is thirty-two (32) (i.e., the total number of cells in the first grid), and the value of N2 is one hundred twenty-eight (128) (i.e., the total number of cells in the second grid). Using the above equation, the grid dimension of the ground plane may be calculated as follows:

$$D_g = \frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve.

As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

For example, FIG. 15 shows the same ground plane as of FIG. 12 enclosed in a third grid with five hundred twelve (512) square cells, each having a length L3. The length (L3) of the cells in the third grid is one half the length (L2) of the cells in the second grid, shown in FIG. 14. As noted above, a portion of the ground plane is enclosed within every square cell in the second grid, thus the value of N for the second grid is one hundred twenty-eight (128). An examination of FIG. 15, however, reveals that the ground plane is enclosed within only five hundred nine (509) of the five hundred twelve (512) cells of the third grid. Therefore, the value of N for the third grid is five hundred nine (509). Using FIG. 14 and FIG. 15, a more accurate value for the grid dimension (D) of the ground plane may be calculated as follows:

$$D_g = -\frac{\log(509) - \log(128)}{\log(2 \times L2) - \log(L2)} \approx 1.9915$$

It should be understood that a grid-dimension curve does not need to include any straight segments. Also, some grid-dimension curves might approach a self-similar or self-affine curves, while some others would rather become dissimilar, that is, not displaying self-similarity or self-affinity at all (see for instance FIG. 12).

The terms explained above can be also applied to curves that extend in three dimensions. If the extension in the third dimension is rather small the curve will fit into an arrangement of 3D-boxes (cubes) in a plane. Then the calculations can be performed as described above. Here the second grid will be composed in the same plane of boxes with the size L2×L2×L1.

If the extension in the third dimension is larger a m×n×o first grid and an 2m×2n×2o second grid will be taken into account. The construction principles for the relevant grids as explained above for two dimensions apply equally in three dimensions. Here the minimum number of cells preferably is 25, 50, 100, 125, 250, 400, 500, 1000, 1500, 2000, 3000, 4000 or 5000.

The grid dimension curve preferably is non-periodic. This applies at least to a portion of the grid dimension curve which is located in an area of more than 30%, 50%, 70%, or 90% of the area which is enclosed by the envelope (see explanation of FIGS. 4*e* and 4*f*) of the grid dimension curve.

Contour Curve

The contour-curve is defined by the ratio Q=C/E given by the ratio of the length C of the circumference of the curve and of the largest extension E of said curve. The circumference is determined by all the borders (the contour) between the inside and the outside of the curve.

The largest extension E is determined by the diameter of the smallest circle, which encloses the curve entirely.

The more complex the curve, the higher the ratio Q. A high value of Q is advantageous in terms of miniaturization.

Examples of contour-curves are shown in FIG. 16. In FIG. 16*a*, left a line 34 composed of straight or almost straight pieces is shown which represents a contour curve. The circumference C of that curve 34 is shown in FIG. 16*a*, right. The curve of a real ground plane will always have a certain line thickness, so that an inner part and an outer part is given such that the circumference is determined by the border between the inner part and the outer part of the curve. The circumference C has a length which corresponds to the double of the length of the curve 34, plus twice the line thickness of that curve. The largest extension E is also shown in FIG. 16*a*, right. The ratio Q is approximately 4.9.

In FIG. 16*b*, left a contour-curve 35 is shown which has an irregular shape. The hatched area is the area of the curve. The circumference and the largest extension E are shown in FIG. 16*b*, right. The circumference here also is given by the border between the inner and the outer part of the curve 35.

In FIG. 16*c*, left a contour-curve 6 (hatched) is shown which additionally has openings 37. The border of that openings 37 contribute to the length of the circumference C (see FIG. 6*c*. right).

In FIG. 16*d* a contour curve 36' (hatched area) with openings 37' is shown in which additionally in one of the openings a further curve piece 36" (hatched) is shown, which is not in direct contact with the remainder 36' of the curve. Due to its proximity to the remainder 36' of the curve it is however electromagnetically coupled to the remainder 36' of the curve. The circumference of the piece 36" also contributes to the length C of the circumference of the curve (see FIG. 16*d*, right).

If the curve is on a folded, bent or curved or otherwise irregular surface, or is provided in any another three-dimensional fashion (i.e. it is not planar), the ratio Q is determined by the length C of the circumference of the orthogonal projection of the curve onto a planar plane. The corresponding largest extension E is also determined from this projection onto the same planar plane. The plane preferably lies in such a way in relation to the three-dimensional curve that the line, which goes along the largest extension F of the three-dimensional curve, lies in the plane (or a parallel and hence equivalent plane). The largest extension F of the three-dimensional curve lies along the line connecting the extreme points of the curve, which contact a sphere, which is given by the smallest possible sphere including the entire curve. Further the plane is oriented preferably in such a way, that the outer border of the projection of the curve onto the plane covers the largest possible area. Other preferred planes are those on which the value of C or Q of the projection onto that plane is maximized.

If for a three-dimensional curve a single projection plane is given in which the ratio Q of the projection of the curve onto the plane is larger than the specified minimal value, or this is the case for one of the above mentioned preferred projection planes the curve is said to be a contour curve. Possible minimum values for Q are 2.1, 2.25, 2.5, 2.75, 3.0, 3.1, 3.2, 3.25, 3.3, 3.5, 3.75, 4.0, 4.5, 5.0, 6, 7, 8, 9, 10, 12, 15, 20, 25, 30, 40, 50, 75, and 100.

In FIG. 16*e* an example of a three-dimensional contour curve 38 is shown. This curve is somehow undulated and shows holes 39. The projection of the curve 38 onto the planar plane 41 is shown with reference sign 40. The projection 40 includes openings corresponding to the holes 39. The ratio Q and the largest Extension E are to be determined from the projection 40. The plane 31 is chosen such that the outer border (not including the border of the holes 39) of the projection 40 covers the largest possible area onto that plane 41.

Another plane 12 is shown in FIG. 16*e* on which the curve 8 is orthogonally projected. The outer border of projection 13 on plane 12 covers an area significantly smaller than the outer border of projection 10 onto plane 11. The same applies to C and Q.

The contour curve preferably is non-periodic. This applies at least to a portion of the contour curve which is located in an area of more than 30%, 50%, 70%, or 90% of the area which is enclosed by the envelope (see explanation of FIGS. 4*e* and 4*f*) of the contour curve (or the above mentioned projection thereof).

Multilevel Structures

In another example, at least a portion of the conductor of the ground plane may be coupled, either through direct contact or electromagnetic coupling, to a conducting surface, such as a conducting polygonal or multilevel surface. Further the shape of the ground plane may include the shape of a multilevel structure. A multilevel structure is formed by gathering several geometrical elements such as polygons or polyhedrons of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements.

At least two of the elements may have a different size. However, also all elements may have the same or approximately the same size. The size of elements of a different type may be compared by comparing their largest diameter.

The majority of the component elements of a multilevel structure have more than 50% of their perimeter (for polygons) or of their surface (for polyhedrons) not in contact with any of the other elements of the structure. Thus, the component elements of a multilevel structure may typically be identified and distinguished, presenting at least two levels of detail: that of the overall structure and that of the polygon or polyhedron elements which form it. Additionally, several multilevel structures may be grouped and coupled electromagnetically to each other to form higher level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel ground plane includes at least two levels of detail in the body of the ground plane: that of the overall structure and that of the majority of the elements (polygons or polyhedrons) which make it up. This may be achieved by ensuring that the area of contact or intersection (if it exists) between the majority of the elements forming the ground plane is only a fraction of the perimeter or surrounding area of said polygons or polyhedrons.

One example property of a multilevel ground plane is that the radioelectric behavior of the ground plane can be similar in more than one frequency band. Input parameters (e.g., impedance) and radiation patterns remain similar for several frequency bands (i.e., the antenna structure has the same level of adaptation or standing wave relationship in each different band), and often the antenna structure present almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure ground plane may have a smaller than usual size as compared to other ground plane of a simpler structure. (Such as those consisting of a single polygon or polyhedron). Additionally, the edge-rich and discontinuity-rich structure of a multilevel ground plane may enhance the radiation process, relatively increasing the radiation resistance of the ground plane and reducing the quality factor Q, i.e. increasing its bandwidth.

A multilevel ground plane structure may be used in many antenna structure configurations, such as dipoles, monopoles, patch or microstrip antennae, coplanar antennae, reflector antennae, aperture antennae, antenna arrays, or other antenna configurations. In addition, multilevel ground plane structures may be formed using many manufacturing techniques, such as printing on a dielectric substrate by photolithography (printed circuit technique); dieing on metal plate, repulsion on dielectric, or others.

The antenna structure of the present invention may be used in a bracelet FM radio, an MP3 player, a radio frequency identification tag (RFID), a keyless remote entry system, a sensor such as an air pressure sensor in tires, radio controlled toys, a mini-PC such as e.g. a notebook PC with an integrated WI-FI module, a compact/wireless card, a wireless USB/UART dongle, a PCMCIA wireless card, a headset, a pocket PC with integrated WI-FI, an access point for hotspots, a wireless light switch, a wireless wrist watch, and a wireless wrist sensor or communication device or any other wireless device.

In a preferred embodiment the maximum extension of the ground plane (determined by the diameter of the smallest sphere completely enclosing the ground plane) is less than $1/5$ or $1/7$ or $1/10$ or $1/15$ or $1/20$ of the free space wavelength of the resonant (operating) frequency of the antenna element.

This criteria can also be used to define the terms space-filling curve, box-counting curve, grid dimension curve or contour curve. This means, that any curve with a maximum extension less than $1/5$ or $1/7$ or $1/10$ or $1/15$ or $1/20$ of the free space wavelength of the resonant (operating) frequency can be said to be a space filling curve, a box counting curve, a grid dimension curve or a contour curve.

BRIEF DESCRIPTION OF THE DRAWINGS

FIG. 3 possible formations of end portions;

DETAILED DESCRIPTION OF SOME PREFERRED EMBODIMENTS

In FIG. 1, some possible shapes of ground planes 1 are shown. Those ground planes are shaped as open loops, wherein an opening is indicated by reference number 2. The portion that would be required to close the opening 2 is preferably smaller than the portion of the open loop.

The opening 2 is located between end portions 3 and 4.

Figure 1A:
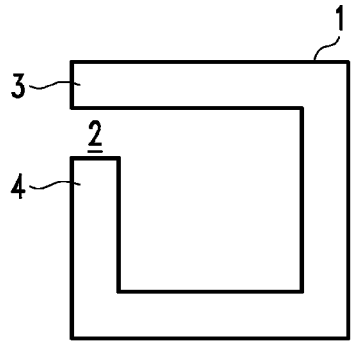
FIG. 1 schematic views of possible ground plane shapes.

In FIG. 1*a*, the ground plane 1 is based on a square loop wherein, on one side of the square, the opening 2 is provided. The ground plane may also be stretched in one or the other directions such that the ground plane 1 is rectangular and not square. Furthermore, the corners may be rounded or shaped differently.

Figure 1B:
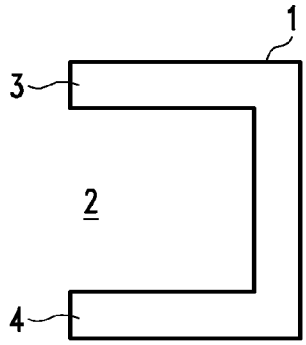

In FIG. 1*b*, the opening 2 is formed by taking away a side portion of a square or rectangular loop. The open loop is therefore formed by the three remaining sides of a square or of a rectangle.

Figure 1C:
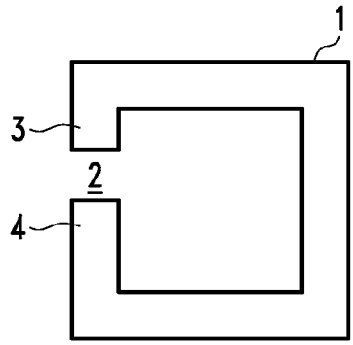

In FIG. 1*c*, a case is shown where only a part of a side of a square or a rectangle is taken away such that a comparatively small opening 2 is formed. This allows for a longer electrically relevant length in comparison to FIG. 1*b*.

Figure 1D:
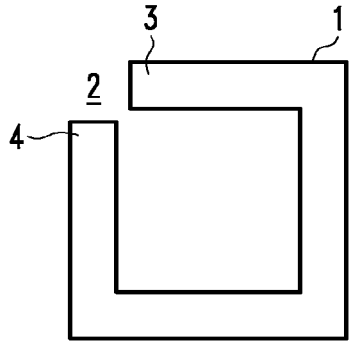

In FIG. 1*d*, the opening 2 is provided at the corner of the rectangular or square ground plane 1. Here a portion of the two sides namely, the upper and the left side has been taken away in order to form the opening and the two end portions 3 and 4.

Figure 1E:
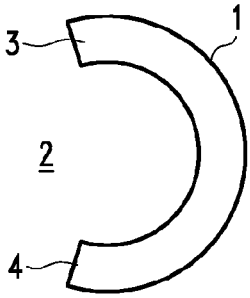

In FIG. 1*e*, a ground plane 1 is shown which has a shape of a portion of a circle. The opening 2 is provided between the two end portions 3 and 4. In this example the circle is closed more than half, such that an open loop is given.

Figure 1F:
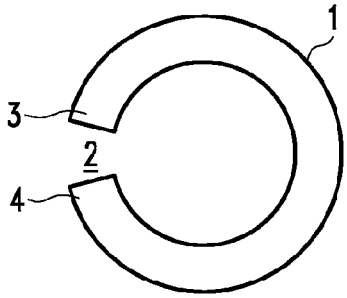

An almost closed circle with a very small opening 2 is shown in FIG. 1*f*.

Instead of circles, also ellipses may be used as ground planes.

Figure 1G:
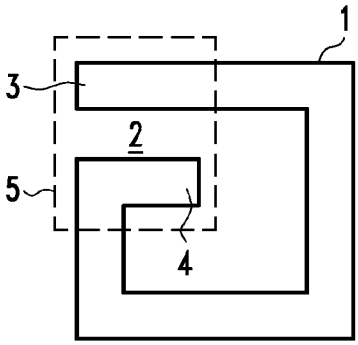
Figure 1H:
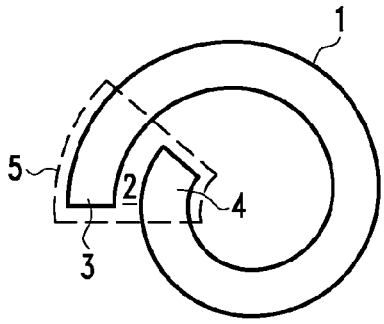

In FIGS. 1*g* and 1*h*, the case is shown where parts of the ground plane 1 overlap in a region 5. Here, the opening 2 is provided between the two overlapping parts which are given by the end portions 3 and 4.

While in FIGS. 1*g* and 1*h*, the overlapping portion 5 is comparatively small, much larger overlapping portions may be given such that at least 10, 15, 20, 30, 40, 50, 60, 70, 80 or 90 percent of the ground plane or the whole plane is overlapping with another part of the ground plane.

Figure 1I:
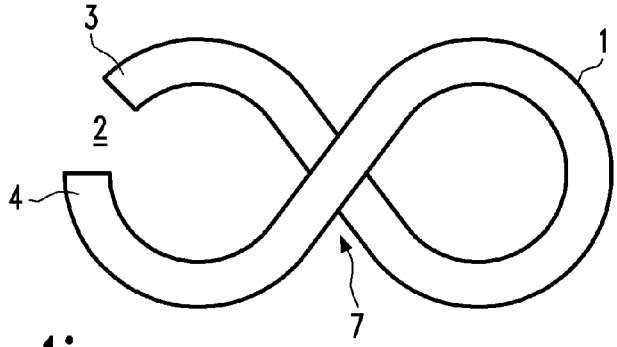

FIG. 1*i* shows an example where the ground plane is formed in a 3-dimensional way and where there is a crossing section 7 where parts of the ground plane overlap, although this overlap is not at the end portions 3, 4. The two parts of the ground plane that cross at the crossing 7 are not in direct electrical contact.

Figure 1J:
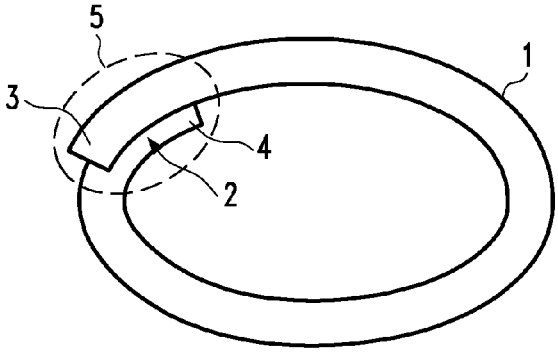

FIG. 1*j* shows another example of a ground plane in 3-dimensions where there is an overlap between the end portions 3 and 4 in the area 5 by the end portion 3 being above the end portion 4.

Figure 1K:
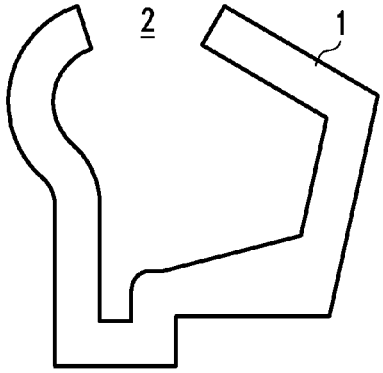
Figure 1L:
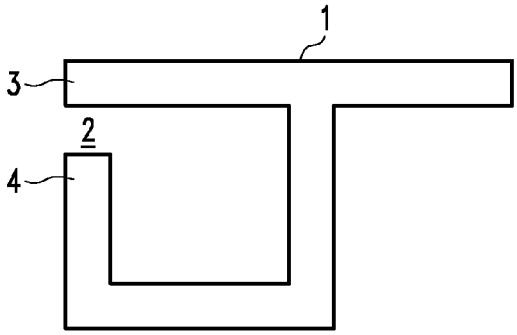

In FIG. 1*k*, an example of a ground plane 1 is shown which is less regular than the previous examples. Here the ground plane is composed of curved and straight segments which also intersect at angles different from 90°. This is an example only showing that the ground plane may have an irregular shape which is composed of different straight segments and/or different curved segments. Different curved segments may be identified by having a curvature in a different direction (left or right curvature). Furthermore, it is shown that it is not necessary that the ground plane has a constant width along its length since the width may vary at different portions of the ground plane.

FIG. 11, is an example of a ground plane which shows that the ground plane may have more than two end portions 3, 4. As can be seen in FIG. 11, on the right hand side there is a third end portion. This additional end portion may or may not end at a second opening. Also four, five or more end portions may be provided.

Figure 1M:
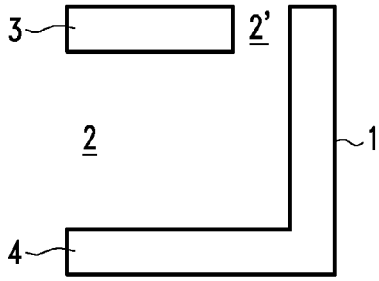

As is, furthermore, shown in FIG. 1*m*, along the loop of the open loop, there may be more than one opening 2. In FIG. 1*m*, an example is shown of a ground plane 1 which has two openings 2 and 2'. It is, however, preferred, that the open loop has no further opening at least in the portion which connects the two end portions 3, 4 of the opening 2.

The examples shown in FIG. 1 are non-limiting examples.

Figure 2A:
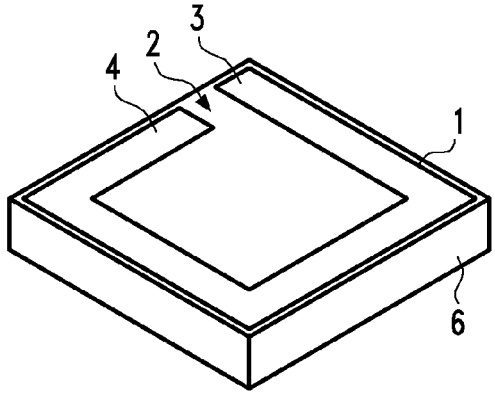
FIG. 2 3-dimensional views of possible ground planes.

In FIG. 2*a*, an example of a realization of a ground plane 1 on a circuit board 6 is shown. The ground plane 1 may be e.g. a copper layer which is printed on the circuit board 6 or etched from a copper layer provided on the circuit board 6.

The ground plane extends along the edge of the circuit board 6. The ground plane 1, however, may also be provided in such a way that part of the edge of the circuit board 6 is not provided with a portion of the ground plane 1. Instead of copper, other good conductors such as gold, brass, aluminum or the like may be used.

Figure 2B:
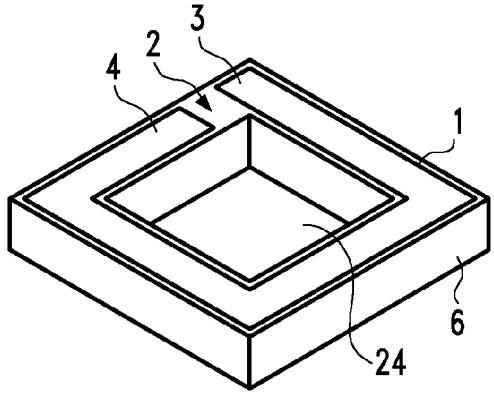

In FIG. 2*b* the circuit board is provided with an opening 24. This opening is in particular useful for other components of the wireless device. E.g. a mechanical connector for the light switch may be located therein or other mechanical or electrical components. More than one opening 24 may be provided. As can be seen in FIG. 2*b*, the ground plane can be fitted on the area around the opening 24. This leads to a good use of little available space.

Figure 2C:
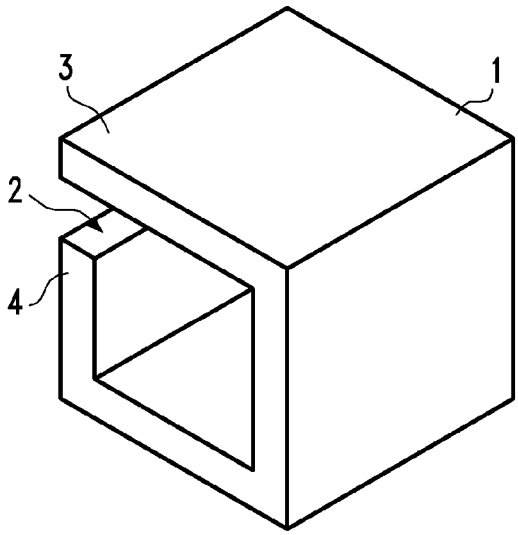

FIG. 2*c* shows an example of a ground plane 1 which extends in a 3-dimensional fashion. The open loop character of the ground plane can be seen in a cross section which is parallel to the front surface of the ground plane. This cross section has a shape similar to that of FIG. 1*a*.

Instead of extending the third dimension in a direction perpendicular to a characteristic cross section, the 3-dimensional geometry of the ground plane may be achieved also by an extension away from the cross section in other angles than 90° such as any angle between 10° and 170°.

Further, it is not necessary that the extension in the direction away from the characteristic cross section is the same at all portions of the ground plane. Some portions may extend further away from the cross section than others.

Figure 3:
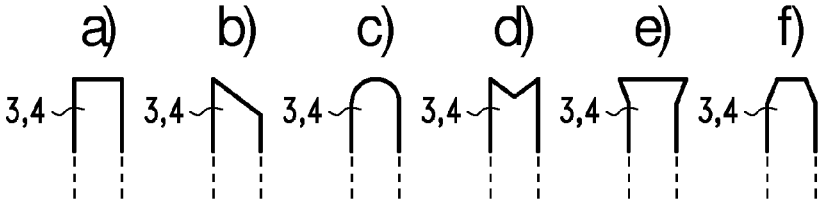

In FIG. 3, possible end formations of the end portions 3, 4 or other end portions of the ground plane 1 are shown. The examples shown in FIG. 3*a* to 3*f*, however, are non-limiting examples.

In FIG. 3*a*, the end portion ends perpendicular to the trace while in FIG. 3*b* the end portions 3, 4 is cut at a tilted direction. In FIG. 3*c*, the end portion is rounded and in FIG. 3*d*, the end portion is provided with two peaks. Further, in FIGS. 3*e* and 3*f*, it is shown that the width of the ground plane may vary towards the end thereof.

One end portion 3 may have another shape than another end portion 4 or any of further end portions of the ground plane 1.

FIG. 4 is provided in order to explain some of the concepts in order to define the open loop geometry.

Figure 4A:
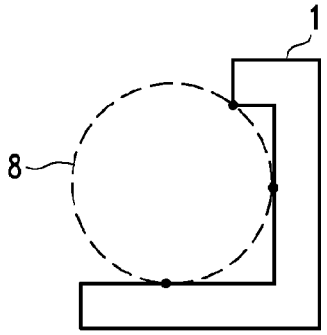
FIG. 4 schematic views in order to explain definitions of open loops.

FIG. 4*a* shows a ground plane 1 which is an open loop since a circle 8 exists which contacts the ground plane 1 at three distinct points.

Figure 4B:
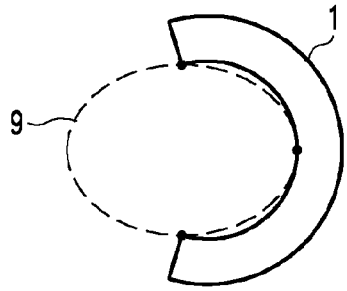

In FIG. 4*b*, a ground plane 1 with the shape of an open loop is shown since there exists an ellipse 9 which contacts the ground plane at three distinct points.

The ground plane is on the outside of the circle or ellipse. Instead of three, also it may be possible that there is contact between the circle or the ellipse at four or more points. The said three, four or more points, however, always should be distinct, which means that they are not provided directly next to each other or connected by a continuous line of contact between the circle or the ellipse and the open loop shape.

Figure 4C:
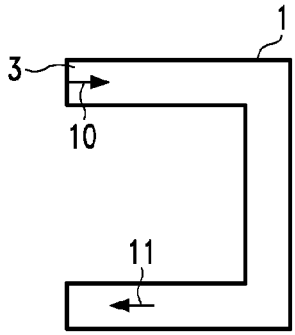
Figure 4D:
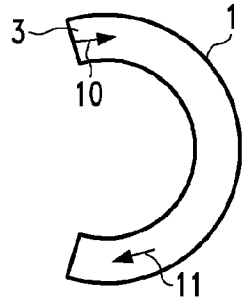

In FIG. 4*c*, a ground plane 1 is shown which extends at the end portion 3 in a direction 10. Following the trace or path of ground plane 1, the lower portion of the ground plane 1 then extends in the direction 11 anti-parallel to the direction 10. The same applies to FIG. 4*d*.

Figure 4E:
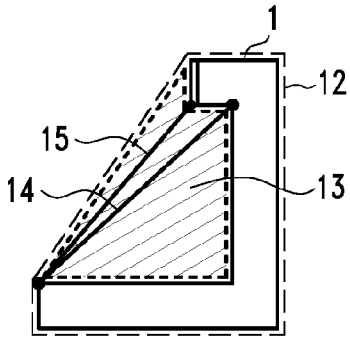

In FIG. 4*e*, an example of a ground plane 1 with an open loop shape is shown. The ground plane 1 has an envelope 12 which is formed by straight lines enclosing the ground shape 1. The straight lines forming the envelope do not have an angle between each other of more than 180 degrees on the inside of the envelope 12. The envelope 12 defines an enclosed area 13 (hatched area) which is enclosed by the envelope 12 but outside of the ground plane 1. The largest diameter of this enclosed area 13 is indicated with the line 14. This line 14 is longer than the shortest possible connection 15, which would be needed in order to close the loop.

Figure 4F:
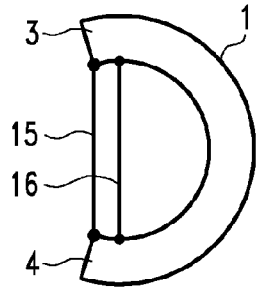

Further, in FIG. 4*f* a ground plane 1 with an open loop geometry is shown since the largest diameter 16 of the enclosed area is larger than the separation of the two end portions 3 and 4 which is indicated by line 15. Further line 15 is shorter than the length of for example 80% of the largest extension of the ground plane 1.

In FIG. 4*f* e.g. on the right hand side the envelope would consist of infinite small straight lines or in other words the envelope is rounded according to the shape where outer portions thereof would be touched by a point of an envelope line only. The same rules for an envelope in two dimensions may be used to define envelops to three-dimensional objects using planes instead of straight lines.

Figure 4G:
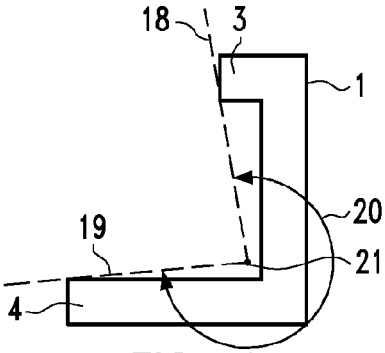
Figure 4H:
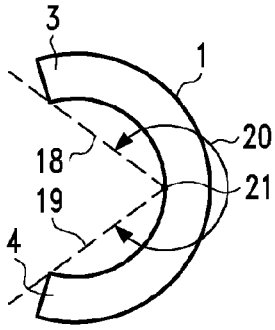

In FIG. 4*g*, an open loop ground plane 1 is shown since there exists a point 21 which has a viewing angle onto the ground plane 1 of larger than 270 degrees. The viewing angle is indicated by reference number 20 and is the angle between the lines 18 and 19 which are the limiting ends of the ground plane 1 on the side of lines 18 and 19 where the ground plane 1 is provided. A similar case is shown in FIG. 4*h*.

In case of a shape such as shown in FIGS. 1*g* and 1*h*, the viewing angle 20 will be said to be more than 360 degrees. This expresses that there exists a point from which there appears an overlap.

Figure 4I:
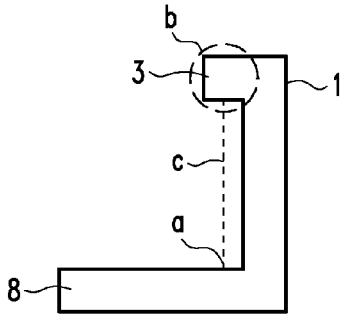
Figure 4J:
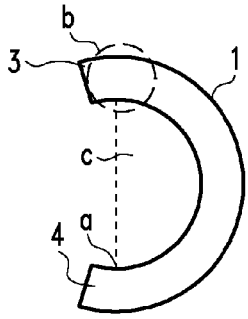

FIG. 4*i* shows a case of an open loop ground plane 1 where there exists a portion "a" of the borderline of the ground plane 1, where in a direction (see line "c") perpendicular to that portion or that point "a", there is another portion "b" of the ground plane 1. The same is shown in FIG. 4*j* which also defines a ground plane with an open loop shape.

Figure 5A:
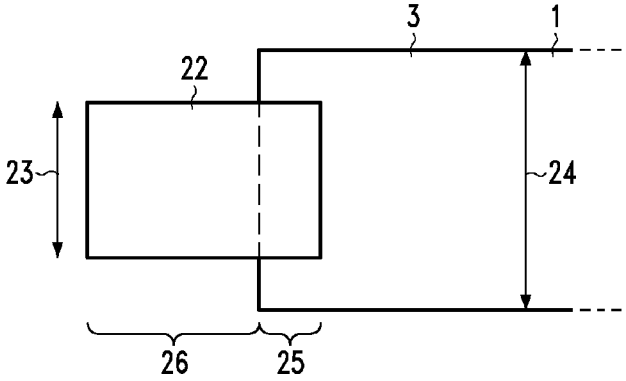
FIG. 5 schematic view of possible arrangements between the antenna element and the ground plane.

In FIG. 5*a*, the relation between an antenna element 22 and the ground plane 1 is shown. The antenna element is provided in proximity to the end portion 3 of the ground plane 1. As can be seen in FIG. 5*a*, the extension 23 and 25 plus 26 of the antenna element is smaller than that of the ground plane 1. In particular the width 23 is smaller than the width 24. The width 23, however, may also be equal to the width 24 or be larger than the width 24.

Furthermore, it can be seen that the antenna element 22 is in partial overlap with the ground plane end portion 3. The antenna element 22 is overlapping at a portion 25 of the antenna element 22 with the ground plane 3 while the portion 26 does not overlap with the ground plane 3.

The arrangement shown in FIG. 5*a* may e.g. be suitable for a monopole antenna element 22 arranged substantially parallel to the ground plane. The size of the portions 25 and 26 may vary. While in FIG. 5*a* a case is shown where the overlapping portion 25 is smaller than the non-overlapping portion 26, the opposite may be the case or both portions may have equal size. It is also possible that there is no overlap portion 25 or no non-overlap portion 26. The latter means that the antenna element is provided entirely above the ground plane 1. In this case the antenna element 22 may be a patch or micro-strip antenna, or a monopole antenna arranged substantially orthogonal to the ground plane.

Figure 5B:
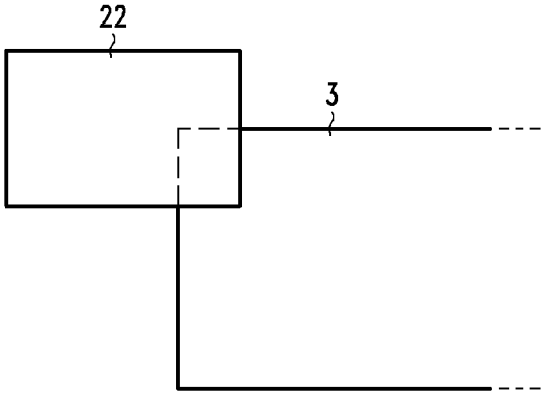
Figure 5C:
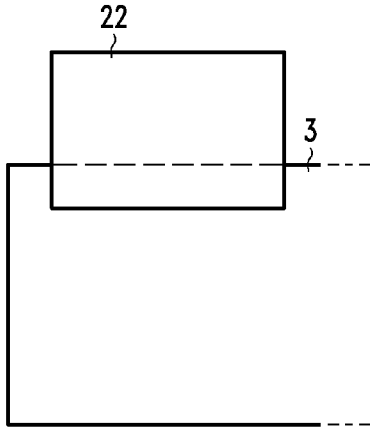

FIGS. 5*b* and 5*c* show other possible arrangements of the antenna element 22. The antenna element 22 may be provided at a corner of the end portion 3, or at a side portion of the end portion 3. Also, in this configuration, the antenna element may be moved further away in the direction of the corner in the case of FIG. 5*b*, or in the direction to the side (in FIG. 5*c* upwards) such that no overlap is given.

Figure 5D:
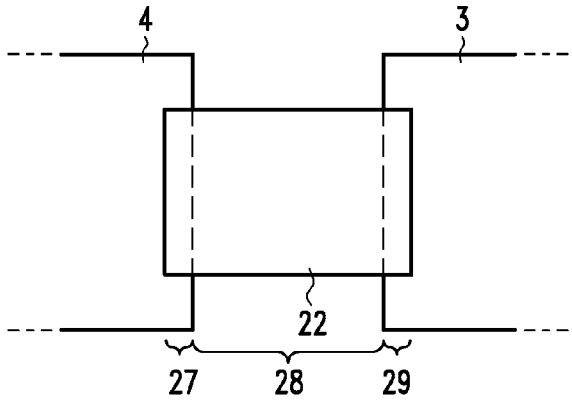

Further, in FIG. 5*d* to 5*g*, the case is shown where the antenna element 22 is provided in the proximity to two end portions 3, 4. In FIG. 5*d* the antenna element 22 has an overlapping portion 27 with end portion 4 and an overlapping portion 29 with end portion 3. Further, a non-overlapping portion 28 is provided within the opening which is defined between the end portions 3 and 4.

Here also, the overlapping portions 27 and 29 do not necessarily have to be of equal size, but may be of different size. Furthermore, the overlapping portion 27 and/or 29 may be larger than the non-overlapping portion 28. Also, all three portions 27, 28 and 29 may have the same size.

As explained for FIG. 5*a*, the width of the antenna element 22 may be the same size as the width of the end portion 3 and/or 4 or be larger than the respective widths.

Figure 5E:
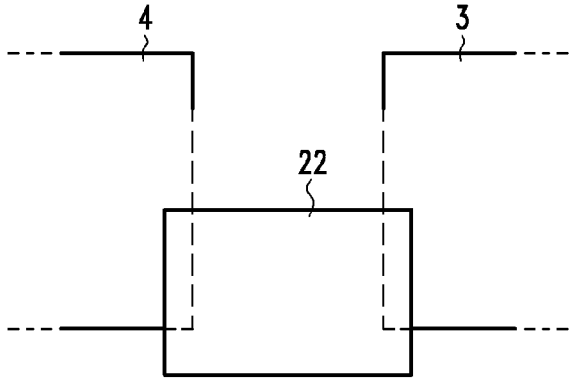

In FIG. 5*e*, the case is shown where the antenna element 22 is provided in overlap with two corners of the end portion 3 and 4. It may, however, also be possible that the two end portions 3 and 4 are not directly in front of each other such that the antenna element 22 overlaps only with one corner e.g. of end portion 3 and with an end part of end portion 3, 4 as shown in FIG. 5*d*.

Figure 5F:
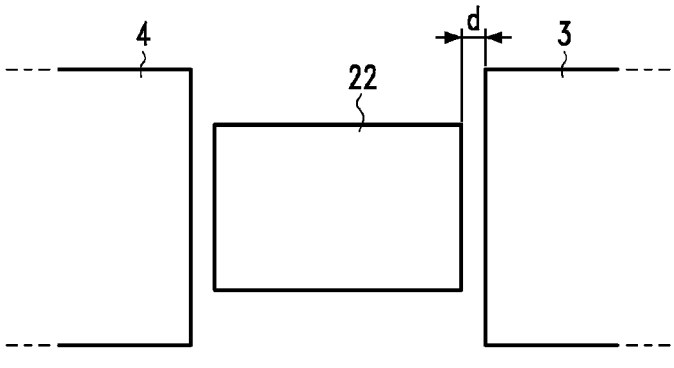

Also, the antenna element 22 as explained above may have no overlap with the end portions 3 and 4 (FIG. 5*f*). Still, however, the antenna element 22 is provided in close proximity to the end portion 3 and 4. The distance d between the end portion 3 and/or 4 and the antenna element 22 should preferably not be larger than e.g. twice the size of the antenna element 22.

Figure 5G:
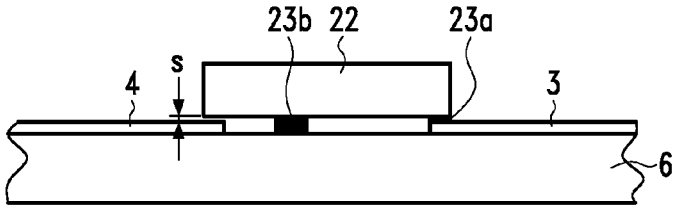

In FIG. 5*g* a cross section of FIG. 5*d* is shown. On a circuit substrate 6 the ground plane end portions 3 and 4 are provided as a thin conducting layer. The antenna element is affixed to the circuit substrate by contact points 23 *a* and 23 *b*. The antenna is electrically directly connected to the ground plane end portion 3 through the contact point 23*a*. The solder point 23*b* may be used to hold the antenna element 22. This solder point may also be used to feed the antenna element 22. The antenna element 22 may be provided at a certain separation s between the antenna element 22 and the ground plane end portion 3 and/or 4. The separation is preferably small or even zero for flat antenna structures.

Although the antenna element 22 is provided above or below the end portion 3, 4 of the ground plane 1 the antenna element is said to be within the opening since in the view of FIG. 5*d* it is within the opening.

Figure 6:
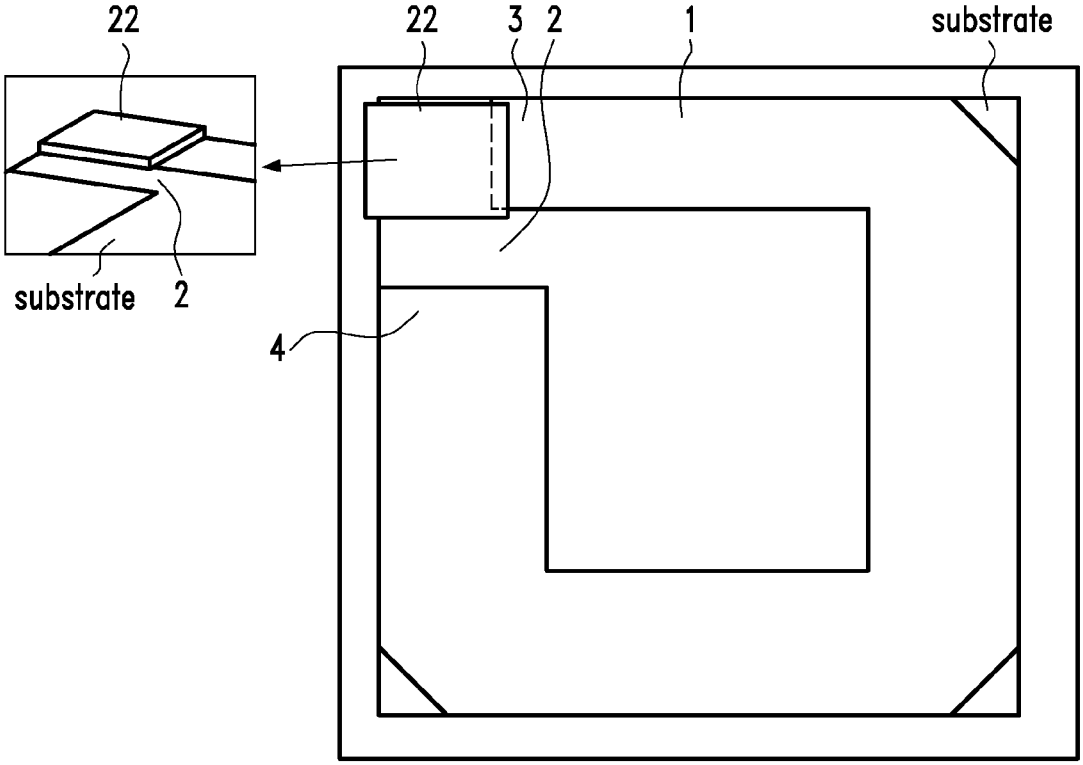
FIG. 6 a schematic view of antenna structure with a square open-loop ground plane including the antenna component.

FIG. 6 illustrates an example of an open-loop or semi-loop ground plane. The ground plane 1 is a conductive material forming an open-loop structure. The ground plane 1 may, for example, be fabricated on or otherwise attached to a dielectric substrate material, such as a printed circuit board. For instance, in the example of FIG. 6, the opening 2 between two end portions 3, 4 of the broken loop 1 is located in the upper left-hand corner. More particularly, FIG. 6 illustrates a square open-loop ground plane 1 with an opening 2 formed between two end portions 3, 4 at the upper left-hand corner of the square. It should be understood, however, that the loop may be shaped other than square.

Also illustrated in FIG. 6 is an antenna component 22 located within the opening 2 formed between the two end portions 3, 4 of the open-loop ground plane 1 and overlapping one of the end portions 3 of the ground plane 1. FIG. 6 includes a close-up view to further illustrate the position of the antenna component 22 with respect to the open-loop ground plane 1. The position of the antenna overlapping an end portion of the ground plane 1 and within the opening 2 defined by the open-loop structure of the ground plane 1 may enhance the antenna performance (e.g., antenna bandwidth and efficiency). The improved antenna performance afforded by its position with respect to the open-loop ground plane may be particularly apparent in the case of a monopole antenna because of the feeding scheme of a typical monopole antenna.

The three corners of the substrate are not covered with a portion of the ground plane 1 such that it will be possible to provide fixing means such as drilling holes in those corners.

The opening 2 is provided in the left side of the square of the ground portion 1. As can be seen in FIG. 6, the width of the ground plane 1 varies. The width in the upper portion is smaller than the width in the left-hand portion.

The antenna element 22 is provided in partial overlap with the top portion of ground plane 1.

This can be seen in the enlarged view which shows in a 3-dimensional way that in the arrangement the antenna element 22 is provided on top of the ground plane 1.

In case of FIGS. 5*a* to 5*f*, the antenna element 22 may be provided a little bit above (see FIG. 5*g*) or below the end portion 3 and/or 4. The separation in the direction perpendicular to the plane of the drawings in FIG. 5*a* to FIG. 5*f* between the antenna element 22 and the end portion 3 and/4 shall usually not be larger than e.g. twice the thickness of the antenna element 22 or twice the largest dimension of the antenna element 22 (e.g. in the drawing plane) or of the ground plane or a fraction of one of those.

As can be seen in FIG. 6, in the enlarged view the separation between the antenna element 22 and the ground plane 1 is less than the thickness of the antenna element 22.

Figure 7:
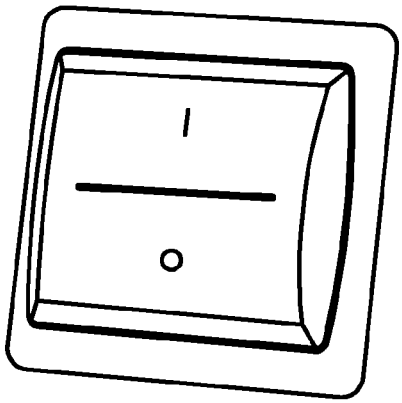
FIG. 7 a schematic view of a light switch with an antenna structure, in particular a view of a wireless light switch, with the example square open-loop ground plane and the antenna component as of FIG. 6.

FIG. 7 shows an example of the light switch which is provided with an antenna structure as shown in FIG. 6. The light switch is a square wireless light switch having a square open-loop ground plane. This is a wall mounted RF transmitter with dimmer and on/off switch for home automation.

Figure 8:
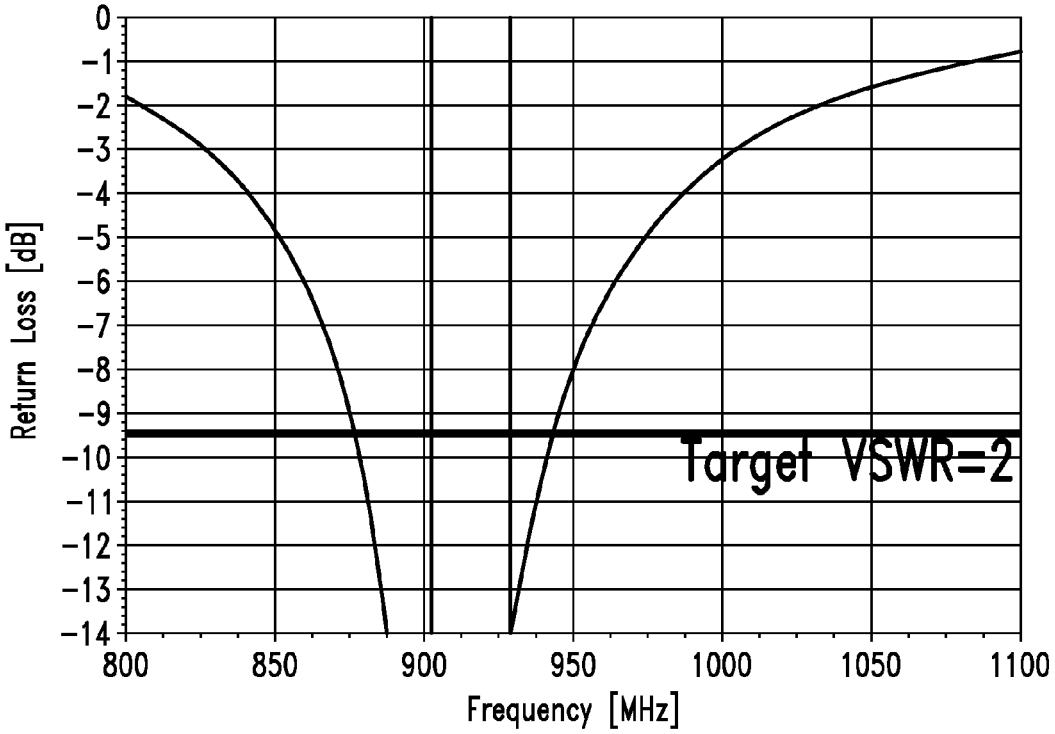
FIG. 8 a schematic view of the return loss and the antenna efficiency of an example antenna structure of the present invention, in particular the return loss and efficiency for the a ZigBee-900 monopole antenna with a square open-loop ground plane.
Figure 8:
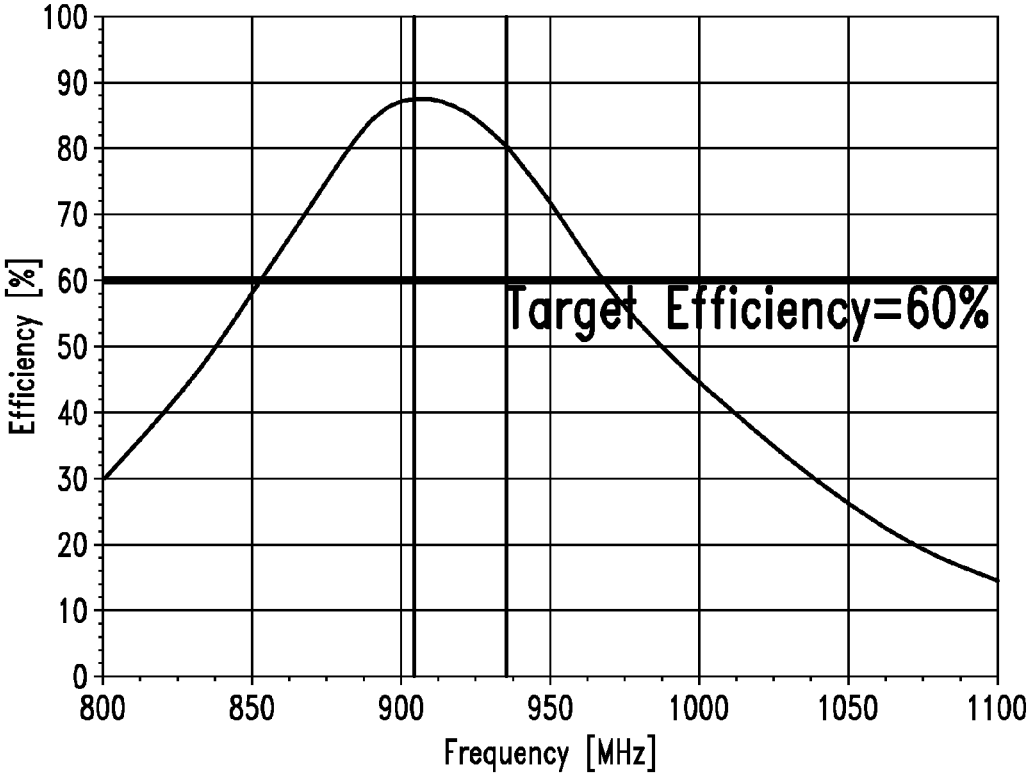

FIG. 8 shows two graphs illustrating an example performance of an antenna component positioned between the end portions of an open-loop ground plane, as shown in FIG. 6. For the purposes of this example, the antenna component is a monopole antenna tuned to resonate at the 900 MHz ZigBee band (902-928 MHz). The upper graph illustrates the return loss of the example antenna structure, and the lower graph illustrates the antenna efficiency.

It should be understood, however, that an open-loop ground plane with an antenna component, as described herein, may also be used for other cellular standards and communication systems, such as Bluetooth, UltraWideBand (UWB), WiFi (IEEE802.11a,b,g), WiMAX (IEEE802.16), PMG, digital radio and television devices (DAB, DBTV), satellite systems such as GPS, Galileo, SDARS, GSM900, GSM1800, PCS1900, Korean PCS (KPCS), CDMA, WCDMA, UMTS, 3G, GSM850, and/or other applications.

Figure 9:
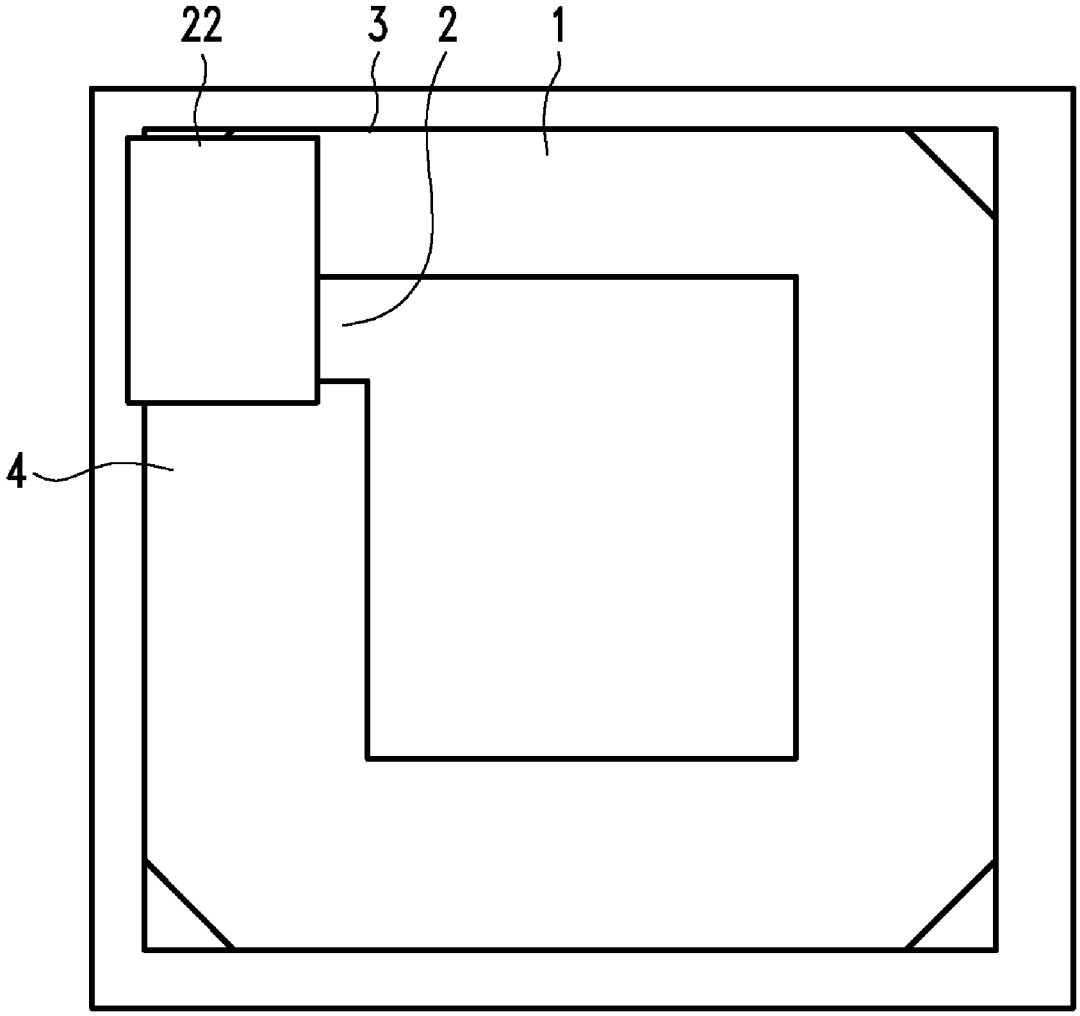
FIG. 9 another schematic view of an antenna structure.

Another configuration of the antenna element 22 is shown in FIG. 9. Here the antenna element 22 overlaps with end portions 3 and 4 which form the opening 2.

With this arrangement, it is easily possible e.g. to couple the antenna by ohmic contact or electromagnetic coupling at one end of the ground plane, while the antenna is also excited at the other end of the ground plane. The antenna may therefore be operated or working as a loop antenna.

Figure 10A:
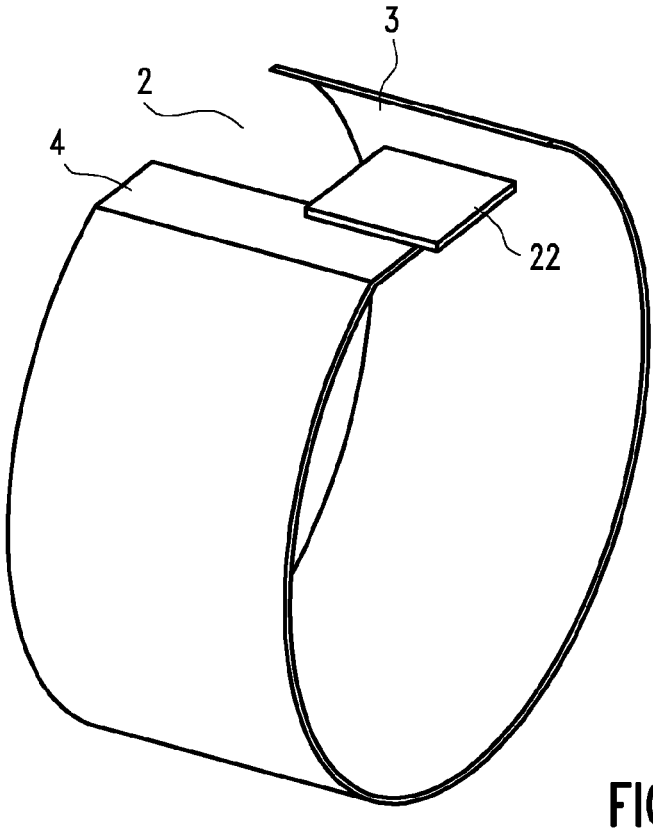
FIG. 10 other schematic 3-dimensional views of antenna structures in particular views of a wireless wrist watch with an example antenna and a circular open-loop ground plane.
Figure 10B:
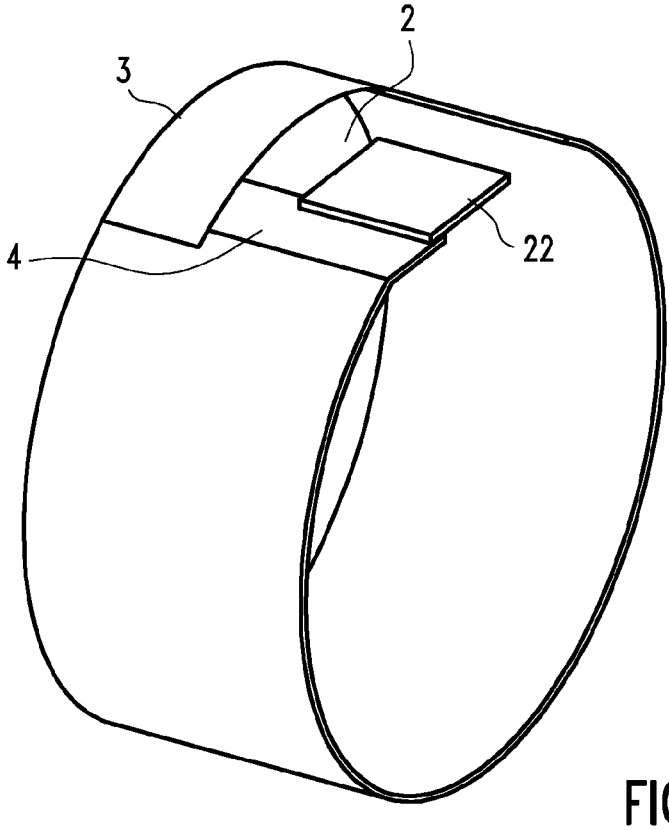
Figure 11A:
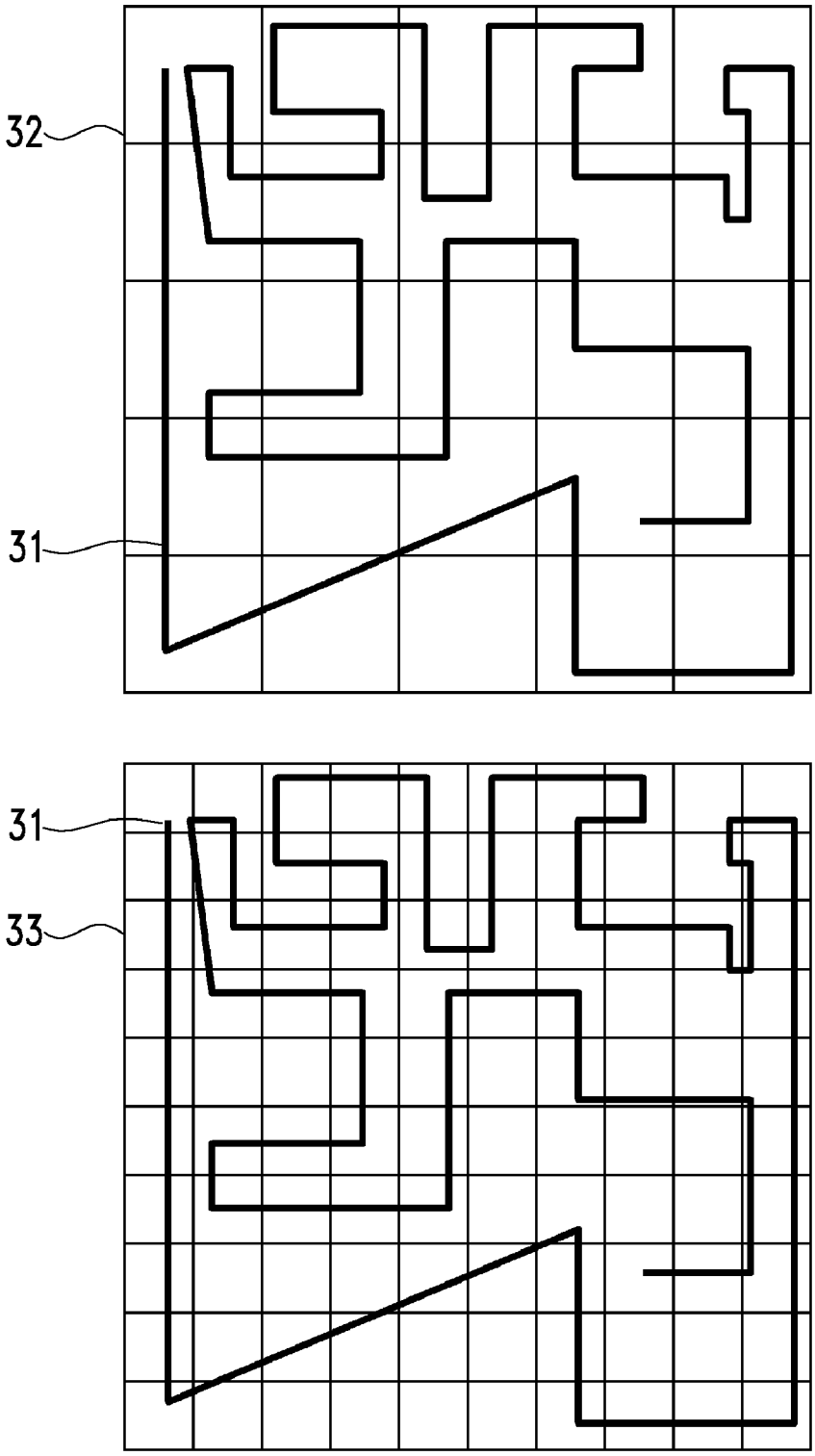
FIG. 11 examples of how to calculate the box counting dimension, and examples 1501 through 1514 of space filling curves for ground plane design (FIG. 11 *b*)
Figure 11B:
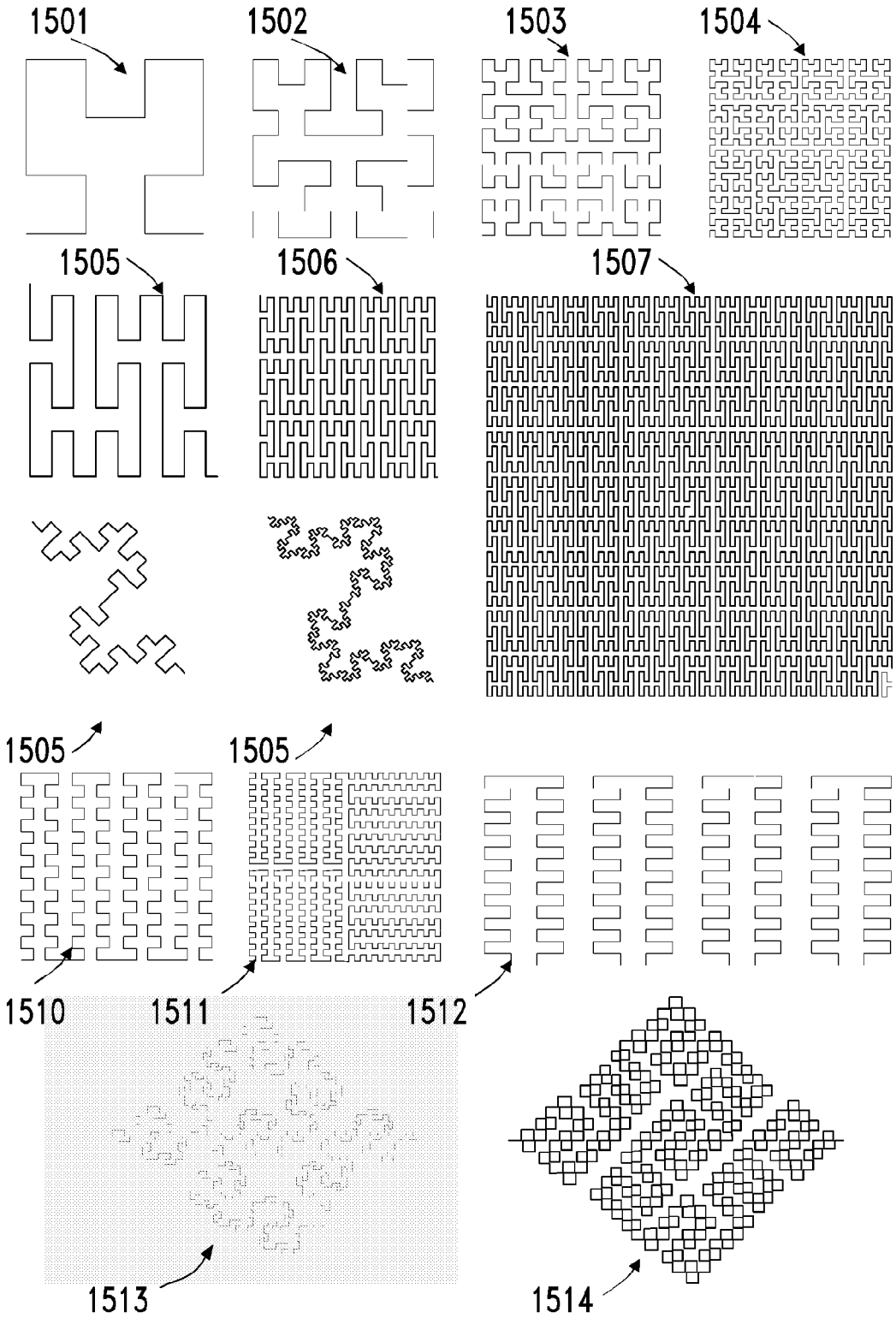
Figures 11C, 11D, 11E:
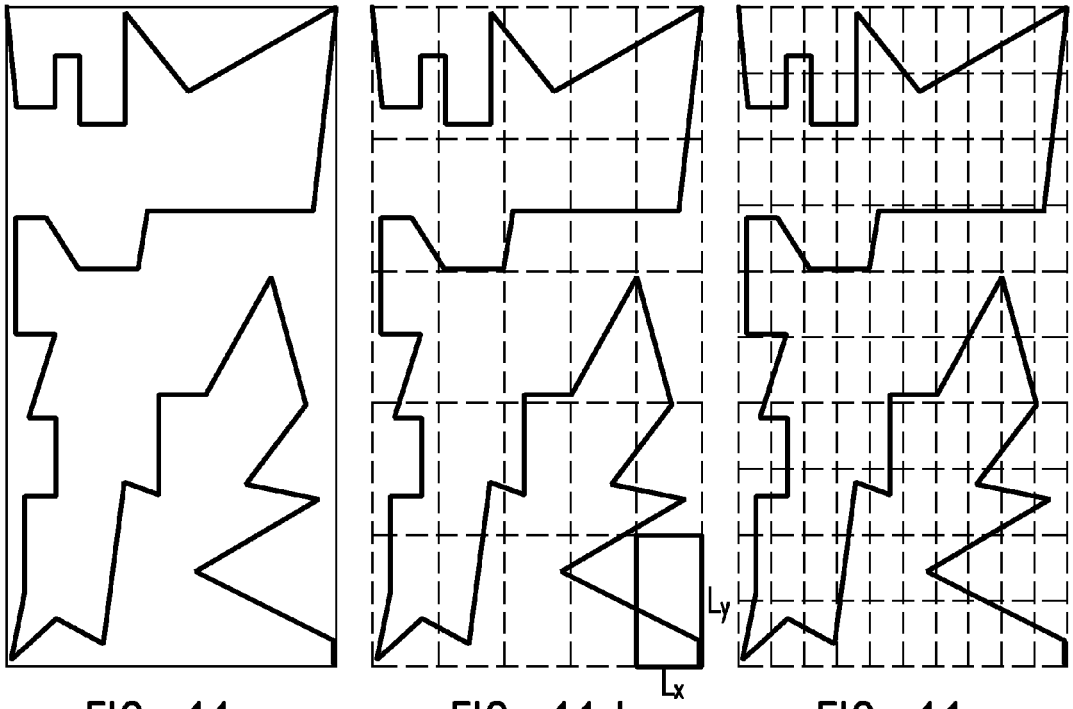
Figure 11F:
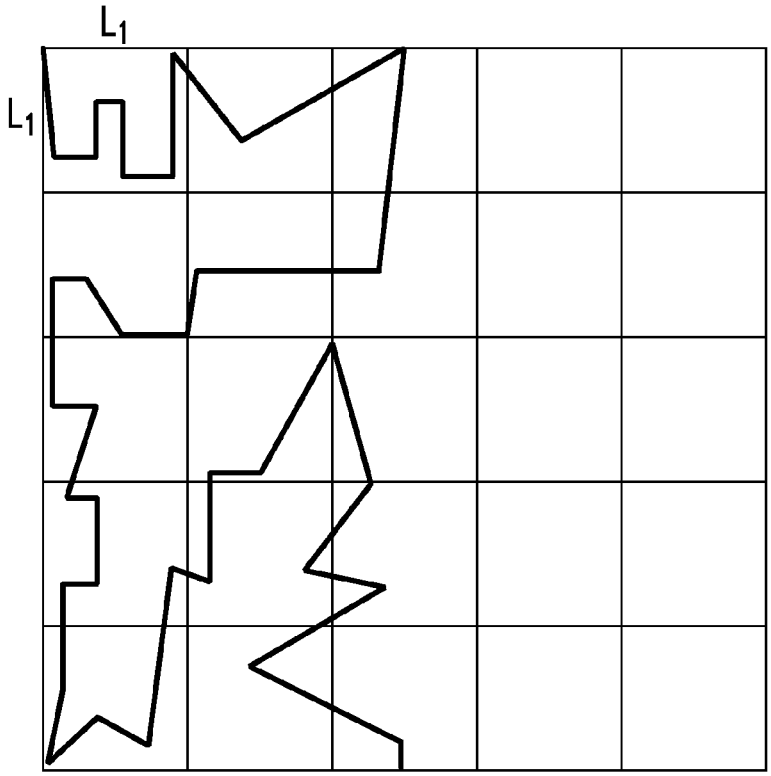
Figure 11G:
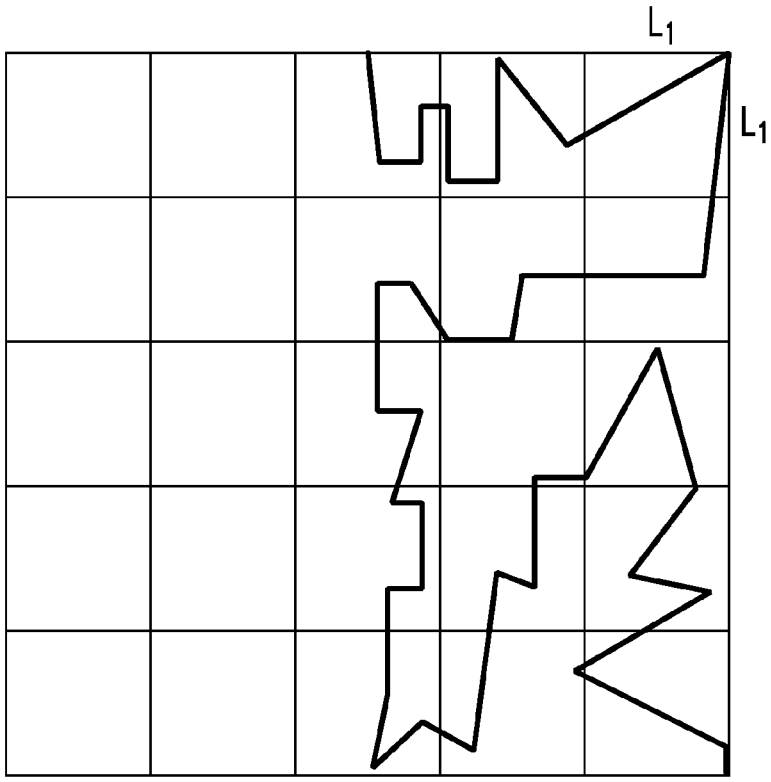
Figure 12:
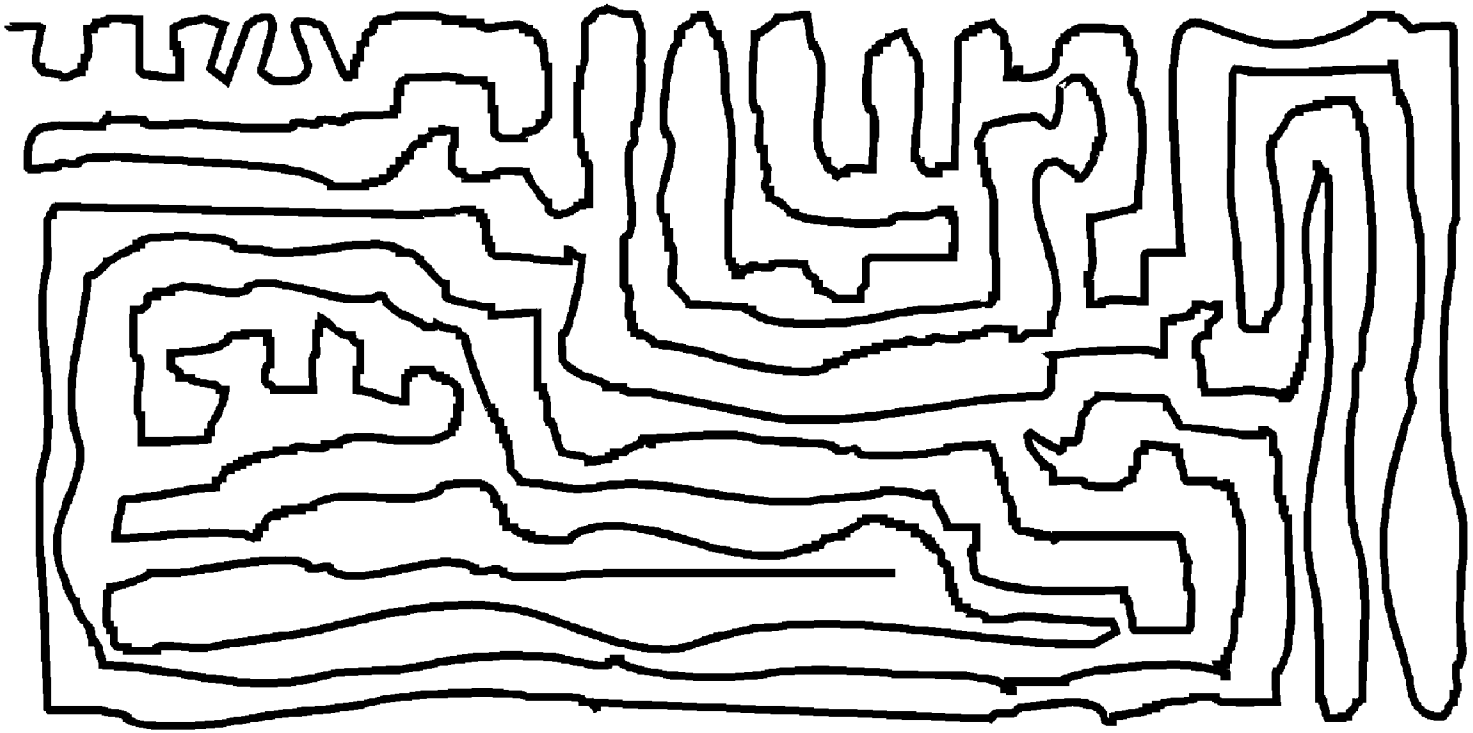
FIG. 12 an example of a curve featuring a grid-dimension larger than 1, referred to herein as a grid-dimension curve.
Figure 13:
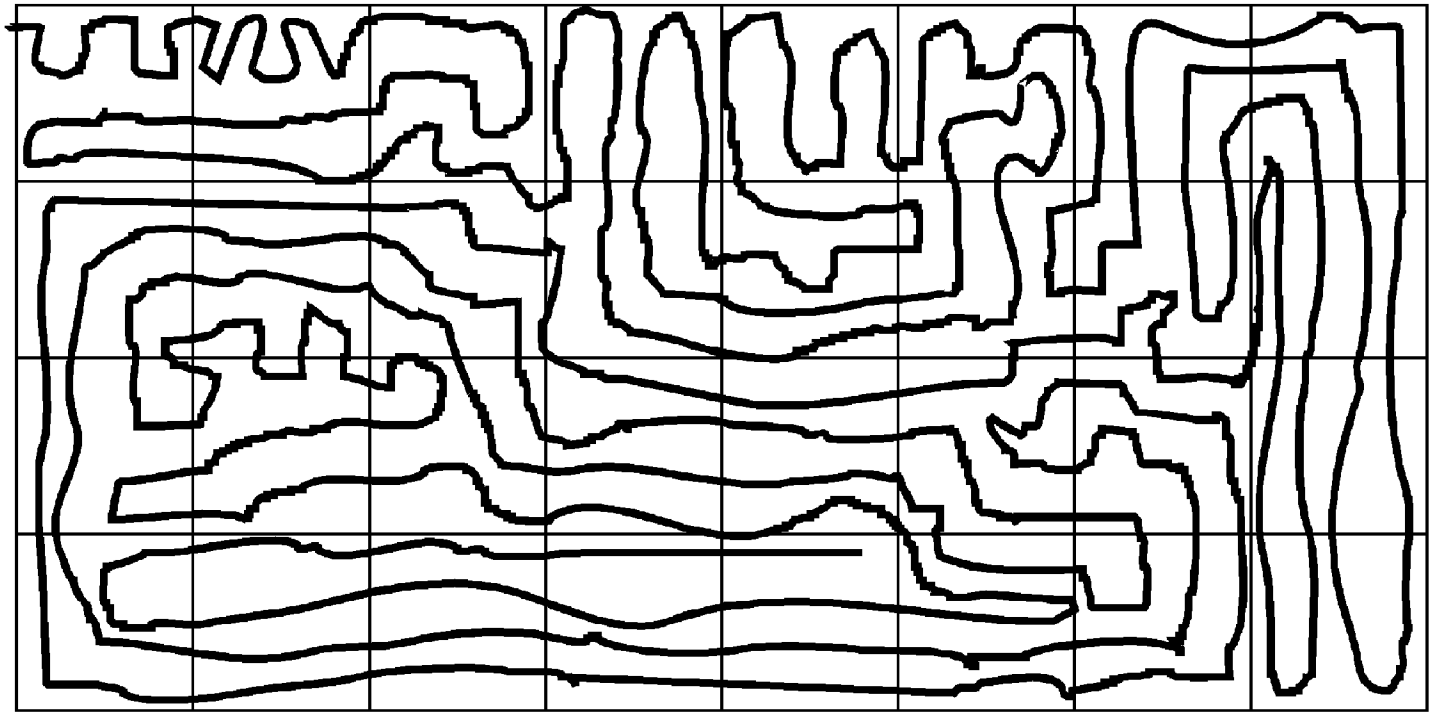
FIG. 13 the curve of FIG. 12 in the 32 cell grid, wherein the curve crosses all 32 cells and therefore N1=32.
Figure 14:
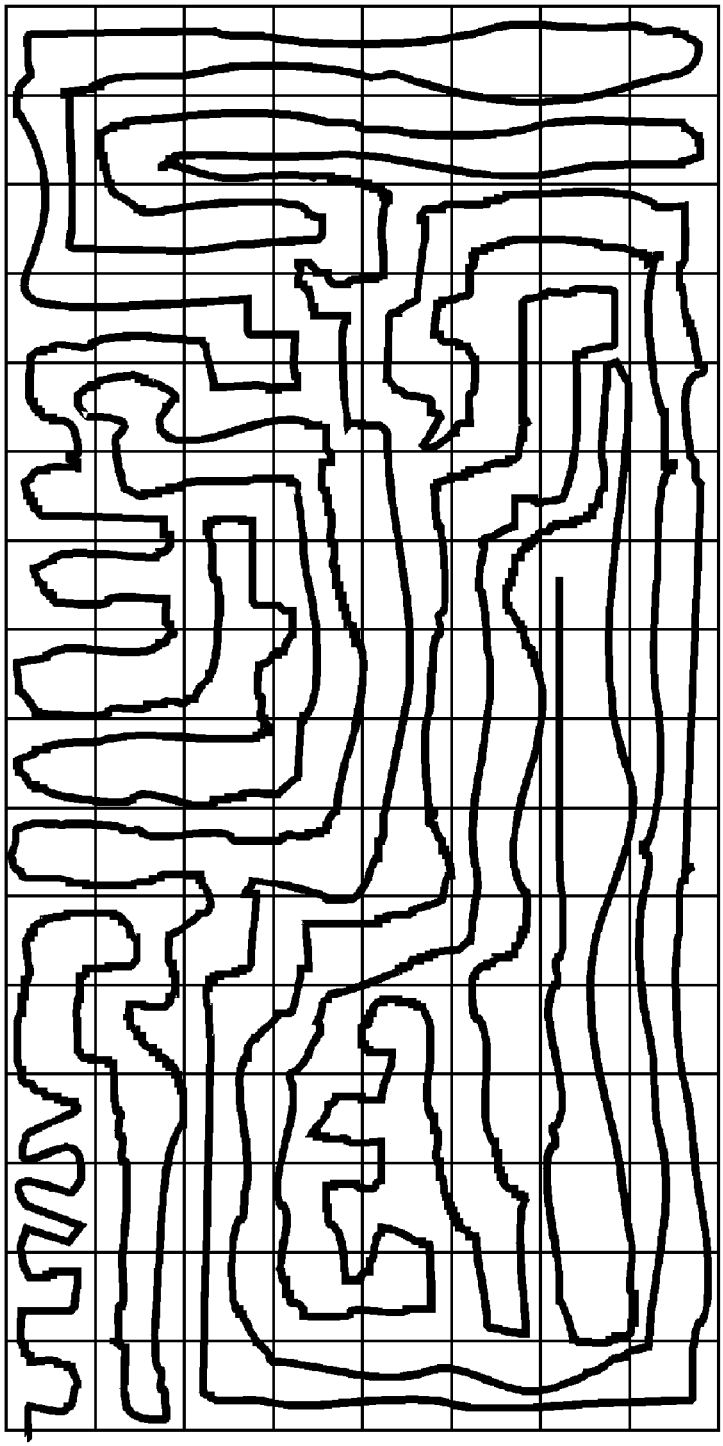
FIG. 14 the curve of FIG. 12 in a 128 cell grid, wherein the curve crosses all 128 cells and therefore N2=128.
Figure 15:
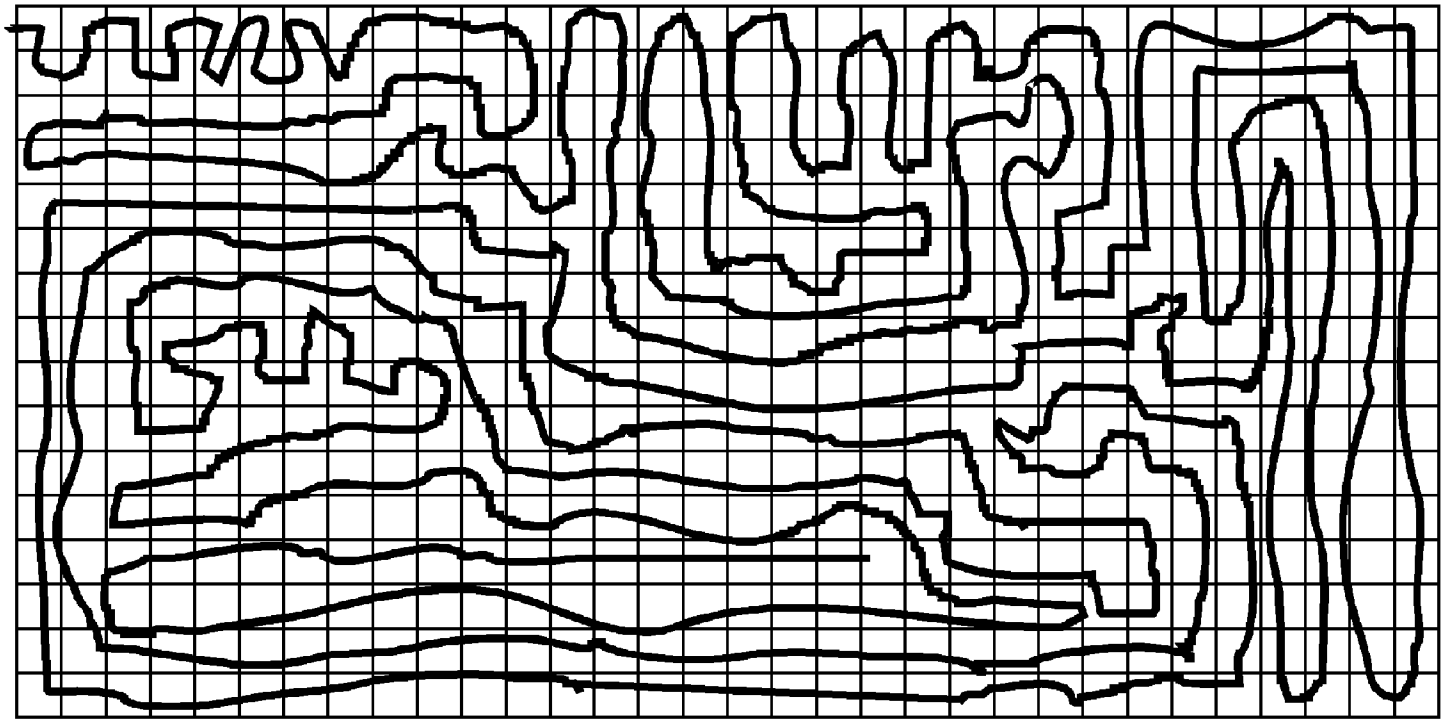
FIG. 15 the curve of FIG. 12 in a 512 cell grid, wherein the curve crosses at least one point of 509 cells.
Figure 16A:
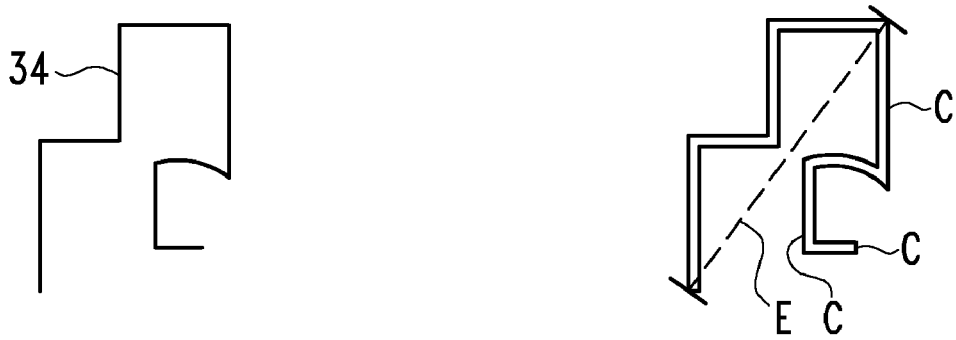
FIG. 16 examples of how to determine the ratio Q for contour-curves.
Figure 16B:
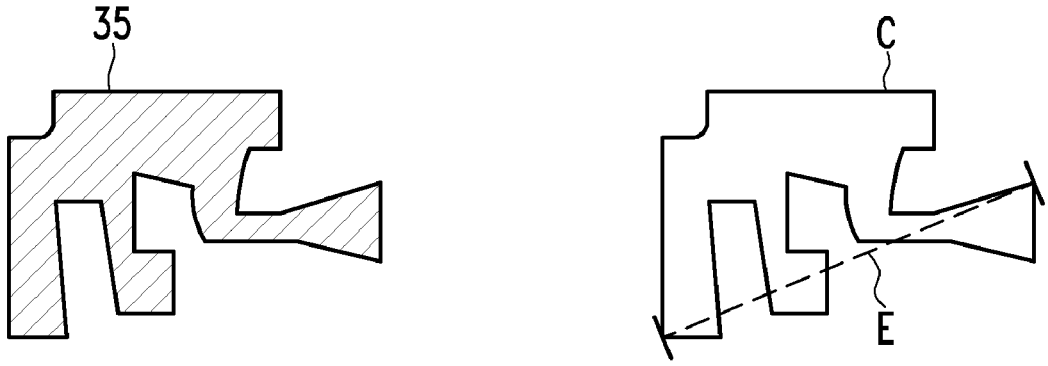
Figure 16C:
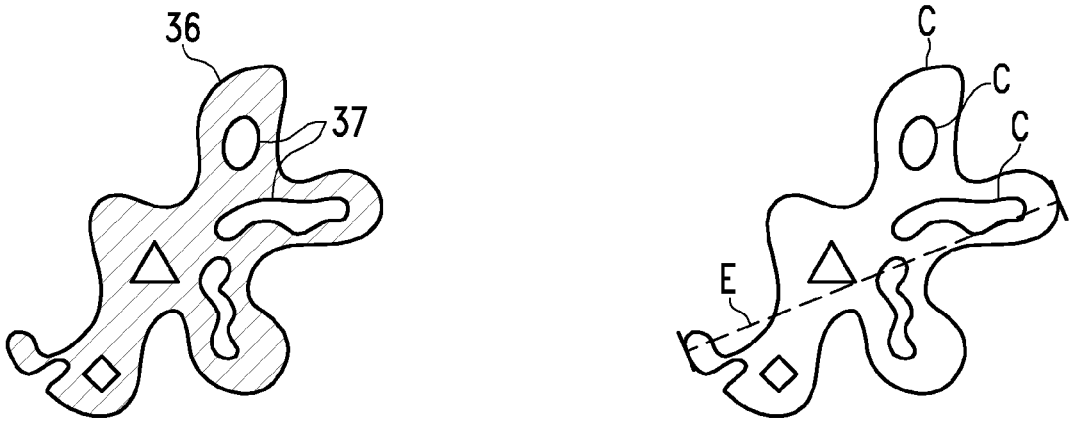
Figure 16D:
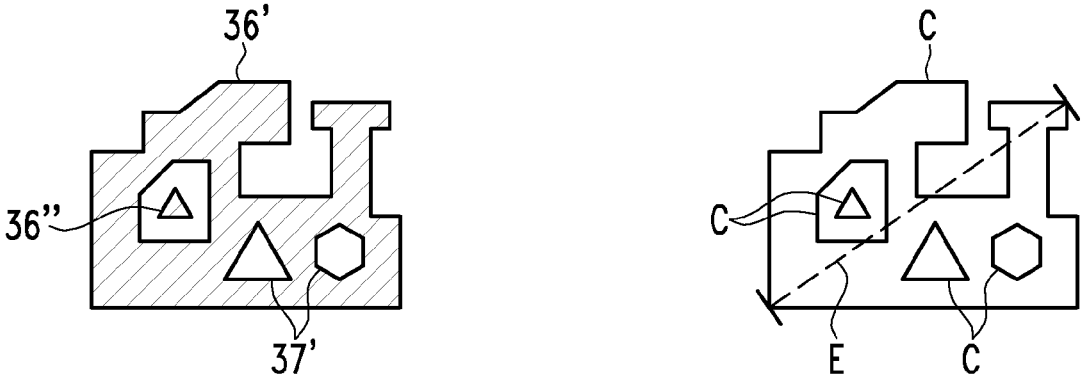
Figure 16E:
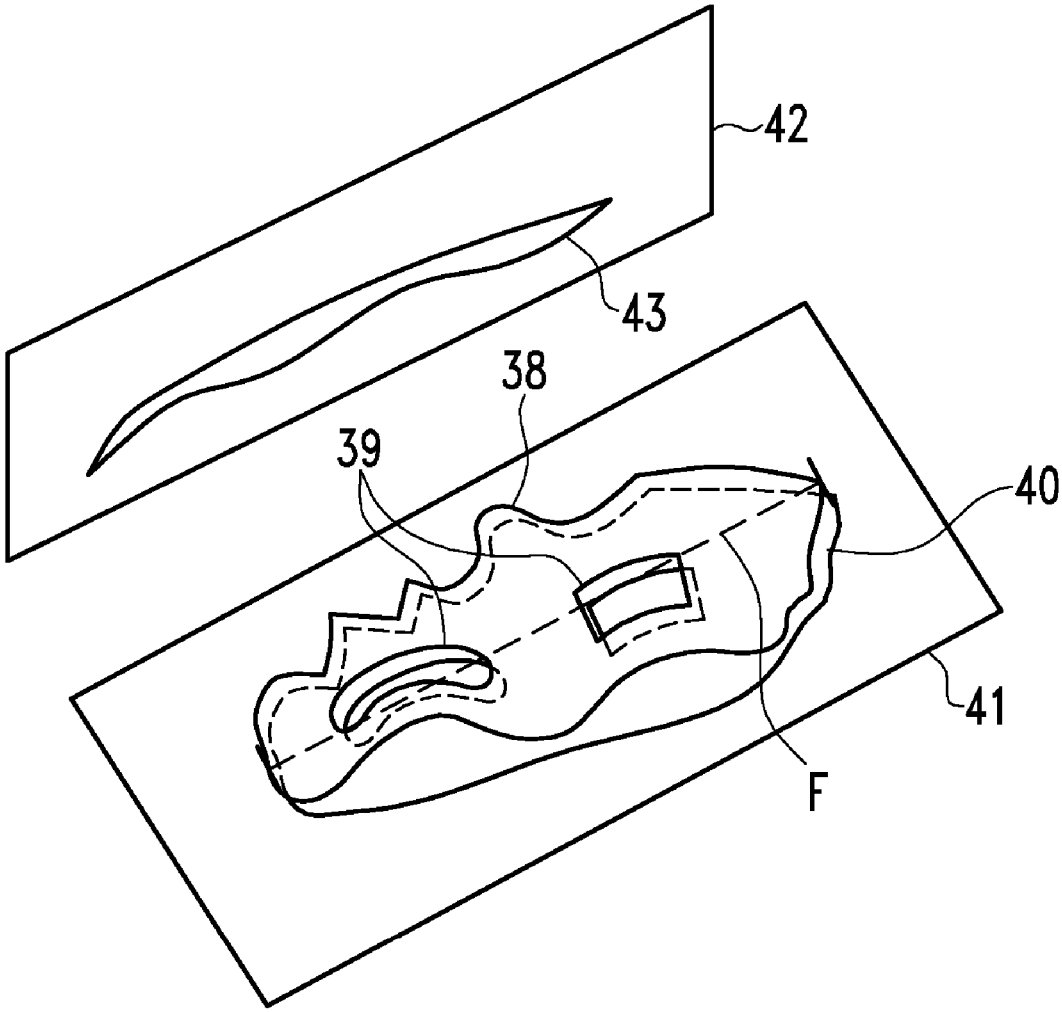

Another example of the antenna structure is shown in FIG. 10*a* and 10*b*. These Figures show a wrist watch having a ring shape open-loop ground plane located in the band portion of the wrist watch. The antenna element 22 is provided in small overlap with the end portion 4. The antenna element 22 is essentially flat, and is provided essentially parallel to the end of the end portion 4. While the end portion 4 is shown flat it may also be curved in the same or a different way as the remainder of that ground plane. In FIG. 10*b*, the case is shown where the ground plane 1 is closed more than 360 degrees such that there is an overlap between the end portions 3 and 4. However, there is no direct electrical contact between the end portions 3 and 4 such that the ground plane still is an open loop. The overlap has a width which is less than the width of the end portion 4.

The antenna element 22 is provided in close proximity to the overlap.

As is shown in FIG. 10*b*, the end portion 3 may have a smaller width than the remainder or other portions of the ground plane 1. Thereby, it is possible e.g. to provide the opening for the antenna element 22. The antenna element 22, in this case, is not covered in a major portion (at least 50%) at the top or at the bottom thereof by the ground plane 1 such that the antenna element may properly radiate electromagnetic waves.

The arrangement as shown in FIG. 10*a* and 10*b* is, in particular, suitable to a monopole antenna element 22.

Further, the arrangement shown in FIG. 10*a* and 10*b* is, in particular suitable, for any device which may be provided at the wrist or at the ankle of a user. The hand or a feet may be passed through the ground plane 1.

The ground plane 1 may e.g. be integrated into the band portion of a wrist watch or any other wrist sensor.

The ground plane 1 here may be integrated into textile or other flexible material. It is therefore advantageous that the ground plane 1 is flexible.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed:

1. An antenna structure for a wireless device comprising:

a ground plane, the ground plane comprising a first end portion and a second end portion, and an antenna element wherein the first end portion and the second end portion form an opening therebetween such that the ground plane has the shape of an open loop that fits within an area having a longest dimension smaller than a quarter of a free-space wavelength of operation of the antenna structure, and wherein the antenna element is located within said opening and in the proximity of at least one of the first end portion and the second end portion.

2. The antenna structure of claim 1, wherein the antenna element is located in the proximity of the first end portion and the second end portion.

3. The antenna structure of claim 1, wherein the ground plane has at least two overlapping portions.

4. The antenna structure of claim 3, wherein the antenna element is located in proximity to the overlapping portions.

5. The antenna structure of claim 1, wherein the antenna element is substantially flat and is arranged substantially parallel to a portion of the ground plane which is located closest to the antenna element.

6. The antenna structure of claim 5, wherein the antenna element is provided such that in a projection of the antenna element onto the portion of the ground plane in the proximity of the antenna element in a direction orthogonal to the plane of the antenna element at least a portion of the antenna element is overlapping with the ground plane.

7. The antenna structure of claim 5, wherein the antenna element is provided such that in a projection of the antenna element onto the portion of the ground plane in the proximity of the antenna element in a direction orthogonal to the plane of the antenna element not less than 50% of the antenna element is overlapping with the ground plane.

8. The antenna structure of claim 5, wherein the antenna element is provided such that in a projection of the antenna element onto the portion of the ground plane in the proximity of the antenna element in a direction orthogonal to the plane of the antenna element not more than 50% of the antenna element is overlapping with the ground plane.

9. The antenna element of claim 1, wherein the ground plane has a first end portion and a second end portion, the ground plane defining an opening between the first end portion and the second end portion and wherein the antenna element is positioned within that opening defined between the first end portion and the second end portion and overlaps with at least one end portion.

10. The antenna structure of claim 1, wherein the ground plane is provided on a circuit board.

11. The antenna structure of claim 10, wherein the ground plane is provided at least in part at a portion of the edge of the circuit board.

12. The antenna structure of claim 10, wherein the circuit board has at least one opening.

13. The antenna structure of claim 12, wherein at least one opening is at least partially surrounded by the ground plane.

14. The antenna structure of claim 10, wherein the ground plane and the antenna element are provided on at least one side of the circuit board.

15. The antenna structure of claim 1, wherein the ground plane is provided as an at least partially rigid conductor.

16. The antenna structure of claim 1, wherein the ground plane is provided as an at least partially flexible conducting material.

17. The antenna structure of claim 1, wherein the antenna element is an antenna component.

18. The antenna structure of claim 1, wherein at least a portion of the ground plane is a multilevel structure, a space filling curve, a grid dimension curve or a contour curve.

19. The antenna structure of claim 1, wherein at least a portion of the antenna element is a multilevel structure, space filling curve, a grid dimension curve or a contour curve.

20. The antenna structure of claim 1, wherein the antenna structure operates in at least one of the following cellular standards and communication systems: Bluetooth, UltraWideBand (UWB), WiFi (IEEE8O2. 11a,b,g), WiMAX (IEEE8O2.16), PMG, digital radio and television devices (DAB, DBTV), satellite systems such as GPS, Galileo, SDARS, GSM900, GSM1800, PCS1900, Korean PCS (KPCS), CDMA, WCDMA, UMTS, 3G, GSM85O, ZigBee (868 and/or 915).

21. The antenna structure of claim 1, wherein the antenna element is selected from the group comprising monopole, IFA, patch, microstrip antenna and PIFA.

22. The antenna structure of claim 1, wherein the antenna element comprises at least one contact point that connects the antenna element to the ground plane by direct electrical contact.

23. The antenna structure of claim 1, wherein the antenna element comprises at least one contact point which is used to feed the antenna.

24. The antenna structure of claim 1, wherein the antenna element is provided at a distance d from the ground plane and end portions thereof, wherein d may be from 2.0 to 0.05 times a largest extension of the antenna element.

25. The antenna structure of claim 1, wherein the antenna element is provided at a separation s from the ground plane and end portions thereof, wherein s may be from 2.0 to 0.05 times a largest extension of the antenna element.

26. The antenna structure of claim 1, wherein the ground plane encloses an enclosed area, the enclosed area being free from ground plane.

27. The antenna structure of claim 26, wherein the enclosed area has a width larger than the length of the smallest closing line between the first end portion and the second end portion.

28. The antenna structure of claim 26, wherein the enclosed area has a largest dimension smaller than a quarter of a free-space wavelength of operation of the antenna structure.

29. The antenna structure of claim 26, wherein the ground plane comprises a conductive layer extending continuously from the first end portion to the second end portion, and wherein a width of the enclosed area is larger than a width of the conductive layer.

30. The antenna structure of claim 26, wherein the enclosed area is larger than an area occupied by the antenna element.

31. An antenna structure for a wireless device, comprising:

an open loop ground plane having a first end portion and a second end portion, the open loop ground plane defining an opening between the first end portion and the second end portion, the first end portion and the second end portion being folded together such that the ground plane fits within an area having a longest dimension smaller than a quarter of a free-space wavelength of operation of the antenna structure; and an antenna component positioned within the opening defined between the first end portion and the second end portion and overlapping at least one of the first end portion or the second end portion.

32. The antenna structure of claim 31, wherein the antenna structure is provided in a light switch.

33. The antenna structure of claim 31, wherein the antenna structure is provided in a wrist sensor.

34. The antenna structure of claim 31, wherein the antenna structure is provided in a wrist watch.

35. A wireless device comprising an antenna structure, the antenna structure comprising:

a ground plane, the ground plane comprising a first end portion and a second end portion, and an antenna element wherein the first end portion and the second end portion form an opening therebetween such that the ground plane has the shape of an open loop that fits within an area having a longest dimension smaller than a quarter of a free-space wavelength of operation of the antenna structure, and wherein the antenna element is located within said opening and in the proximity of at least one of the first end portion and the second end portion.

36. The wireless device of claim 35, wherein the wireless device is selected from the group of wireless devices comprising: mini-PCI (e.g., notebook PC with integrated Wi-Fi module), compact flash wireless cards, wireless USB/UART dongles, PCMCIA wireless cards, headsets, pocket PC with integrated Wi-Fi, access points for hot-spots, wireless light switches, wireless wrist watches, wireless wrist sensors, a bracelet FM radio, an MP3 player, a radio frequency identification tag (RFID), a keyless remote entry system, a sensor such as an air pressure sensor in tires, radio controlled toys, a compact/wireless card, or any other wireless device.

37. A method to integrate an antenna structure in a wireless device comprising the steps of:

providing a ground plane to said wireless device, the ground plane comprising a first end portion and a second end portion;

folding the first end portion and the second end portion together so as to form an opening therebetween such that said ground plane has the shape of an open loop that fits within an area having a longest dimension smaller than a quarter of a free-space wavelength of operation of the antenna structure;

and arranging an antenna element within said opening and in the proximity of at least one of the first end portion and the second end portion.

38. The method as of claim 37, wherein said antenna element is provided within said opening.

39. The method of claim 37, wherein the method is carried out such that the antenna structure fits in the wireless device while said wireless device keeps its size reduced.

40. A wireless device comprising an antenna structure, the antenna structure comprising:

an open loop ground plane having a first end portion and a second end portion, the open loop ground plane defining an opening between the first end portion and the second end portion, the first end portion and the second end portion being folded together such that the ground plane fits within an area having a longest dimension smaller than a quarter of a free-space wavelength of operation of the antenna structure; and an antenna component positioned within the opening defined between the first end portion and the second end portion and overlapping at least one of the first end portion or the second end portion.

* * * * *